US011564519B1

(12) United States Patent
Mills

(10) Patent No.: US 11,564,519 B1
(45) Date of Patent: Jan. 31, 2023

(54) AUTOMATIC SELF-ADJUSTING BEVERAGE CONTAINER RECEPTACLE

(71) Applicant: Kayco, Inc., Bristol, TN (US)

(72) Inventor: Matthew D. Mills, Bristol, TN (US)

( * ) Notice: Subject to any disclaimer, the term of this patent is extended or adjusted under 35 U.S.C. 154(b) by 0 days.

(21) Appl. No.: 16/949,846

(22) Filed: Nov. 17, 2020

Related U.S. Application Data

(63) Continuation-in-part of application No. 16/516,748, filed on Jul. 19, 2019, now abandoned.

(60) Provisional application No. 63/198,450, filed on Oct. 20, 2020, provisional application No. 62/849,184, filed on May 17, 2019, provisional application No. 62/813,784, filed on Mar. 5, 2019, provisional application No. 62/803,213, filed on Feb. 8, 2019.

(51) Int. Cl.
*B65D 23/08* (2006.01)
*A47G 23/02* (2006.01)

(52) U.S. Cl.
CPC ..... *A47G 23/0241* (2013.01); *A47G 23/0216* (2013.01); *B65D 23/0885* (2013.01)

(58) Field of Classification Search
CPC ..... A47G 23/0216; A47G 23/0241; B65D 25/24; B65D 23/0885; B65D 25/22; B65D 25/2811; B65D 25/282; B65D 25/2826; B65D 25/2829; B65D 25/2832; B65D 25/2802
See application file for complete search history.

(56) References Cited

U.S. PATENT DOCUMENTS

D166,832 S * 5/1952 Carew ..... 220/772
2,610,491 A * 9/1952 Carew ..... A47G 23/0216 248/145.3
5,211,307 A 5/1993 Jeffries
D386,650 S 11/1997 Bennett et al.
5,765,715 A * 6/1998 Hughes ..... A47G 23/0216 220/737
6,557,351 B1 5/2003 Ghedini et al.
(Continued)

FOREIGN PATENT DOCUMENTS

CN 3430715 3/2005
CN 301602818 7/2011
(Continued)

OTHER PUBLICATIONS

Shine, Cup Holder, Product Code: 60503W, http://www.hadnet.org.uk/_shop/Shop/Household/default.aspx, 2011, 1 pg.
(Continued)

*Primary Examiner* — Stephen J Castellano
(74) *Attorney, Agent, or Firm* — Krishna Kalidindi

(57) ABSTRACT

An automatic self-adjusting beverage container receptacle has a plurality of handles for the end-user to stabilize the receptacle in operation. The receptacle contains a plurality of parallel polygons of flexible bands inside the receptacle that permit a caregiver to easily and quickly insert a beverage container. The bands also stabilize and grip the container in operation to prevent it from shifting or falling out when the receptacle is lifted and tilted by the end user in consuming the beverage. An accessory mounting system permits the rapid attachment of accessories in a temporary, semi-permanent, or permanent fashion, making each receptacle assembly customizable for individual users.

17 Claims, 19 Drawing Sheets

(56) References Cited

U.S. PATENT DOCUMENTS

| | | | | |
|---|---|---|---|---|
| D479,940 | S | 9/2003 | English | |
| 6,851,276 | B2 * | 2/2005 | Perrins | A45C 11/20 62/530 |
| D519,324 | S | 4/2006 | Martin | |
| 7,040,678 | B1 * | 5/2006 | Haakenson | A47G 23/0241 294/32 |
| 7,275,729 | B2 | 10/2007 | Sherman et al. | |
| D682,031 | S | 5/2013 | Poppie | |
| D721,924 | S | 2/2015 | Trafton | |
| D721,925 | S | 2/2015 | Feldman et al. | |
| D788,530 | S | 6/2017 | Kestenbaum et al. | |
| 9,844,846 | B2 | 12/2017 | Terzini | |
| 2004/0118860 | A1 | 6/2004 | Leopold et al. | |
| 2008/0011925 | A1 | 1/2008 | Ruff et al. | |
| 2011/0198309 | A1 | 8/2011 | Itzek et al. | |
| 2018/0072461 | A1 | 3/2018 | Lane, II et al. | |

FOREIGN PATENT DOCUMENTS

| | | | |
|---|---|---|---|
| CN | 302886807 | | 7/2014 |
| CN | 304412347 | | 12/2017 |
| CN | 304412348 | | 12/2017 |
| CN | 304832556 | | 9/2018 |
| CN | 304964250 | | 12/2018 |
| EM | 002649780-0005 | | 5/2015 |
| JP | D1236547 | | 4/2005 |
| JP | D1597186 | | 1/2018 |
| JP | D1605073 | | 4/2018 |
| KR | 300684774.0000 | | 3/2013 |
| RU | 00082261 | | 7/2012 |
| WO | WO2017/021672 | A1 | 2/2017 |

OTHER PUBLICATIONS

Two Handed Cup Holder, https://www.welcomemobility.co.uk/Products/Two-Handed-Cup-Holder.aspx, 2 pp.

Ergo Plus Cup, https://www.co-opmobility.co.UK/in-the-home/dining/cups/p/drinking-cup, 2019, 3 pp.

PrimoChill ZenCoils—Tube Reservoir Calming Coil—Silver, https://www.primochill.com/products/primochill-zencoils-tube-reservoir-calming-coil-silver, 2019, 4 pp.

* cited by examiner

AUTOMATIC SELF-ADJUSTING BEVERAGE CONTAINER RECEPTACLE

This application claims the benefit under 35 U.S.C. § 119 of U.S. provisional patent application Ser. No. 63/198,450, filed 20 Oct. 2020 by the present inventor, and is a continuation-in-part (CIP) and claims priority under 35 U.S.C. § 120 to, U.S. patent application Ser. No. 16/516,748, filed 19 Jul. 2019 by the present inventor, which claims priority under 35 U.S.C. § 119 to U.S. provisional patent application Ser. No. 62/803,213, filed 8 Feb. 2019 by the present inventor, U.S. provisional patent application Ser. No. 62/813,784, filed 5 Mar. 2019 by the present inventor and U.S. provisional patent application Ser. No. 62/849,184, filed 17 May 2019 by the present inventor, the entireties of which are incorporated by reference herein.

BACKGROUND

Field of Endeavor

The present invention is related to a secondary receptacle for containers holding beverages, and more particularly to a receptacle that can hold multiple size beverage containers without need of manual adjustments and can be more easily held.

Brief Description of the Related Art

The following is a tabulation of some related prior art:

| U.S. patents | | | |
|---|---|---|---|
| Pat. No. | Kind Code | Issue Date | Patentee |
| 5,211,307 | A | 1993 May 18, | Jeffries |
| 6,557,351 | B1 | 2003 May 6, | Ghedini & Montanari |
| 6,851,276 | B2 | 2005 Feb. 8, | Perrins |
| 7,275,729 | B2 | 2007 Oct. 2, | Sherman & Halley |
| U.S. patent application Publications | | | |
| Publication No. | Kind Code | Publication Date | Applicant |
| U.S. 2004/0118860 | A1 | 2004 Jun. 24, | Leopold & Kaupp |
| U.S. 2011/0198309 | A1 | 2011 Aug. 18, | Itzek et al. |
| U.S. 2018/0072461 | A1 | 2018 Mar. 15, | Lane et al. |
| International Patent Applications | | | |
| Intl. Publication No. | Kind Code | Publication Date | Applicant |
| WO 2017/021672 | A1 | 2017 Feb. 9, | Clark |
| Nonpatent Literature Documents | | | |
| Co-Operative Mobility Web Sales www.co-opmobility.co.uk/in-the-home/dining/cups/p/ergo-plus-cup | | | |
| Co-Operative Mobility Web Sales www.co-opmobility.co.uk/in-the-home/dining/cups/p/caring-cup?o=43036 | | | |

In 2016 the number of persons in the United States that were 65 years old or more reached 50 million for the first time. Looking back 16 years to 2000 the number was only 35 million but looking forward 15 years to 2030 the estimate is that there will be more than 71 million persons over 65 years of age. Coupled with the rapid rise in healthcare costs (approximately 54500 per capita in 2000 versus a $12,000 per capita in 2020), there is a need to extract all the savings from the care system possible, without reducing quality of care.

Senior adults may suffer from poor coordination, degraded reflexes, palsy, tremors, or lack of strength. Many of these conditions are similar to those of infants who have not yet learned the basics of self-care. With senior adults, however, this loss of ability to care for one's self has a detrimental effect on self-esteem and happiness critical to senior well-being.

In addition to this aging population, approximately seven to 12 million persons of all ages suffer from Essential Tremor. Essential Tremor (ET) is a neurological disorder that causes rhythmic involuntary shaking, most often of the hands. Adding to this group of persons affected by neuromuscular disorders are the approximately one million US residents suffering from Parkinson's disease, which is frequently indicated by hand and arm tremors. This represents one of every 25 Americans that can benefit from assistive devices for tremors.

If persons with such ailments could drink without assistance that would free a caregiver to assist others in greater need while at the same time instill a greater sense of dignity to the user. Some devices exist for this purpose, but they offer limited flexibility.

For example, Jeffries' U.S. Pat. No. 5,211,307 proposes an insulated container holder for a baby bottle. The idea was that the bottle could be placed in the two-handled holder and then the entire assembly could be given to the baby, transferring the responsibility of holding the bottle from the caregiver (the parent) to the end user (the baby). Given that the infant may take a good deal of time finishing the bottle, the caregiver is freed to perform other tasks.

This implementation, however, relies on the baby bottle being a precise or nearly precise (depending on flexibility) diameter. The bottle is retained by a "discrete compression force" exerted by the inner wall against the outer wall of the bottle. Either the bottle must be manufactured to pair with the holder or a suitable pair must be found by trial and error.

In U.S. Pat. No. 6,851,276, to Perrins, uses a mechanism that can accept containers of different sizes by placing a split diaphragm at the top of an insulated beverage/food container. This design is specifically meant for the beverage container to be removed for consumption, and it provides the diaphragm for the purpose of insulation and sealing. The beverage containers will be stable as long as they are in the upright position, but are subject to normal limitations after removal for consumption.

Another form of split diaphragm is referenced by Sherman and Halley in U.S. Pat. No. 7,275,729, this one with a series of "resilient gripping fingers." Again, however, these are designed to stabilize the container when at rest, but not in use. Other examples of resting stability devices are found in U.S. Patent Application Publications 2004/0118860 and 2011/0198309.

Jeffries' original design also used two handles so that the small, and presumably weak and uncoordinated, infant could manage the device's operation. Other designs, such as that pictured in FIG. 19, use two handles for impaired adults, but these suffer from the same affliction of being specifically sized for one container. Unlike infants, adults may consume beverages in bottles, cans, or boxes of sizes ranging from five or six ounces (juice boxes) to more than 20 ounces (soda or water bottles). In addition, the shapes vary from square to rectangular to round, and the walls may be vertical or contoured. Pouring the contents of the container into a specific-sized container takes time and requires the consumption container be washed after each use.

Lane et al's U.S. Patent Application Publication No. 2018/0072461 touches on the possibility of manufacturing a modular drinking container to receive accessories. While this device is flexible, the inner sleeve is itself the container, which would require the beverage be poured into it for consumption. In addition, the accessory mounts on the outer sleeve are all on the side of the device, not the bottom. Thus, if an accessory such as an extra-wide base was to be attached, it would have to be hooked to one of the slots on the side of the outer sleeve.

Given the limitations of either the inability to adapt to an indeterminate size beverage container, or the failure to make an adjustable device function when non-horizontal, persons who cannot hold their beverage containers directly must be assisted in some way. This assistance takes the caregiver away from other tasks, possibly for the duration of a meal, leading to an increased need for additional human resources.

SUMMARY

In accordance with one embodiment a beverage container receptacle comprises a shell with a plurality of handles and a set of flexible bands within the shell to stabilize and retain most beverage containers inserted into it, with these bands retained vertically by a series of two or more slots placed at one or more levels parallel to the base of the shell. The shell also implements an accessory mounting system on the bottom of the assembly so that appurtenances may be readily attached temporarily, semi-permanently, or permanently.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The inventions of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
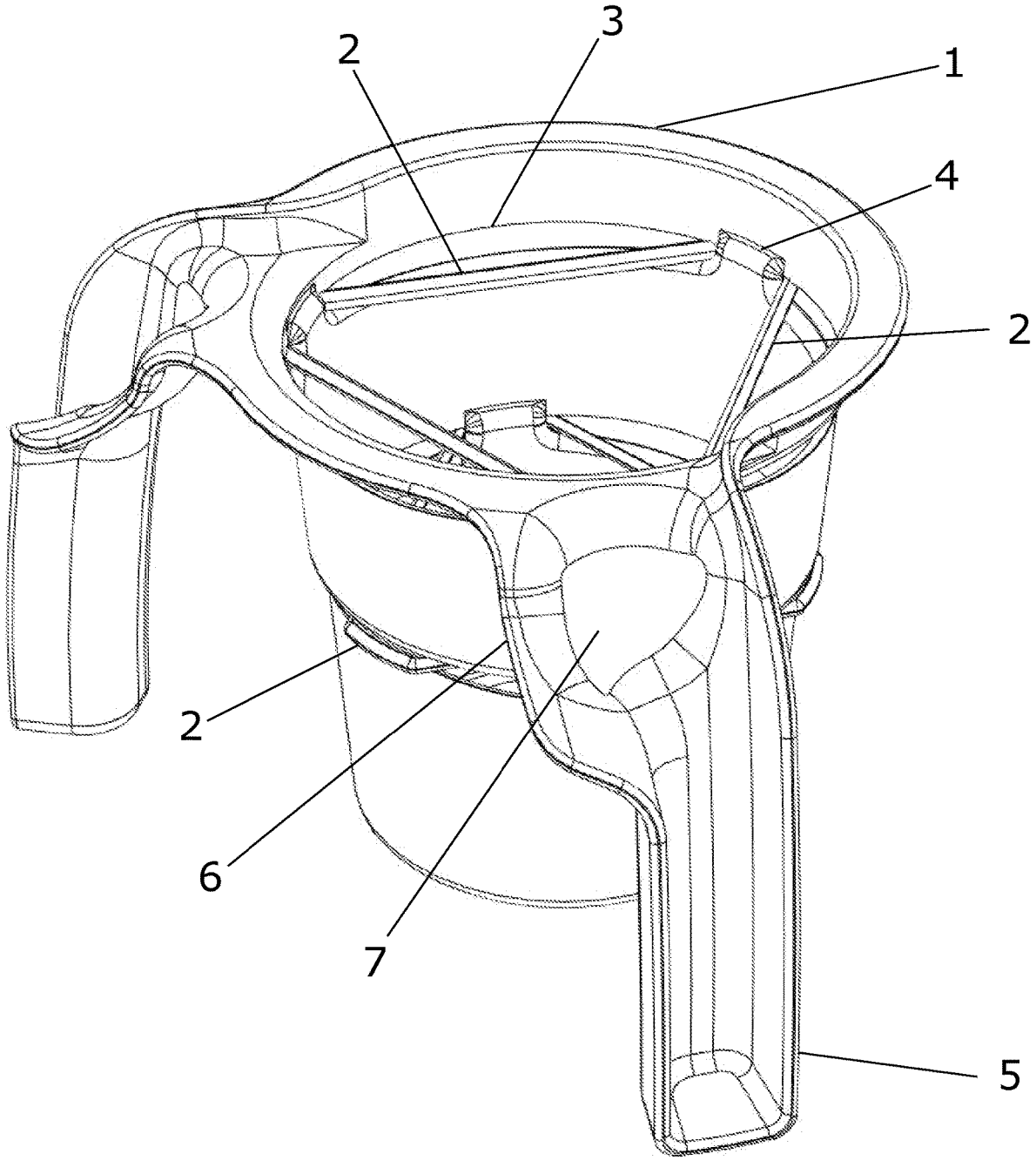
FIG. 1 shows a top perspective view of an exemplary assembly, showing a shell, flexible bands, and two handles, all common to all embodiments.

Referring to the drawing figures, like reference numerals designate identical or corresponding elements throughout the several figures.

The singular forms "a," "an," and "the" include plural referents unless the context clearly dictates otherwise. Thus, for example, reference to "a solvent" includes reference to one or more of such solvents, and reference to "the dispersant" includes reference to one or more of such dispersants.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a range of 1 to 5 should be interpreted to include not only the explicitly recited limits of 1 and 5, but also to include individual values such as 2, 2.7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10."

The devices described herein, in their various embodiments, can overcome the limitations of the prior art by implementing a beverage container receptacle that accepts a wide variety of shapes and sizes of these containers, while automatically self-adjusting to hold these containers stable when the user picks the receptacle up to drink. It advantageously, yet optionally, incorporates a plurality of handles (preferably two) to allow the user to grasp both at the same time in order to better stabilize the assembly, giving the user a better chance at successfully consuming the beverage with little or no assistance. It further may implement an accessory mounting system on the bottom of the shell which increases the stability of the device by lowering its center of gravity at rest.

Other advantages of one or more aspects will be apparent from a consideration of the drawings and ensuing description.

Figure 2:
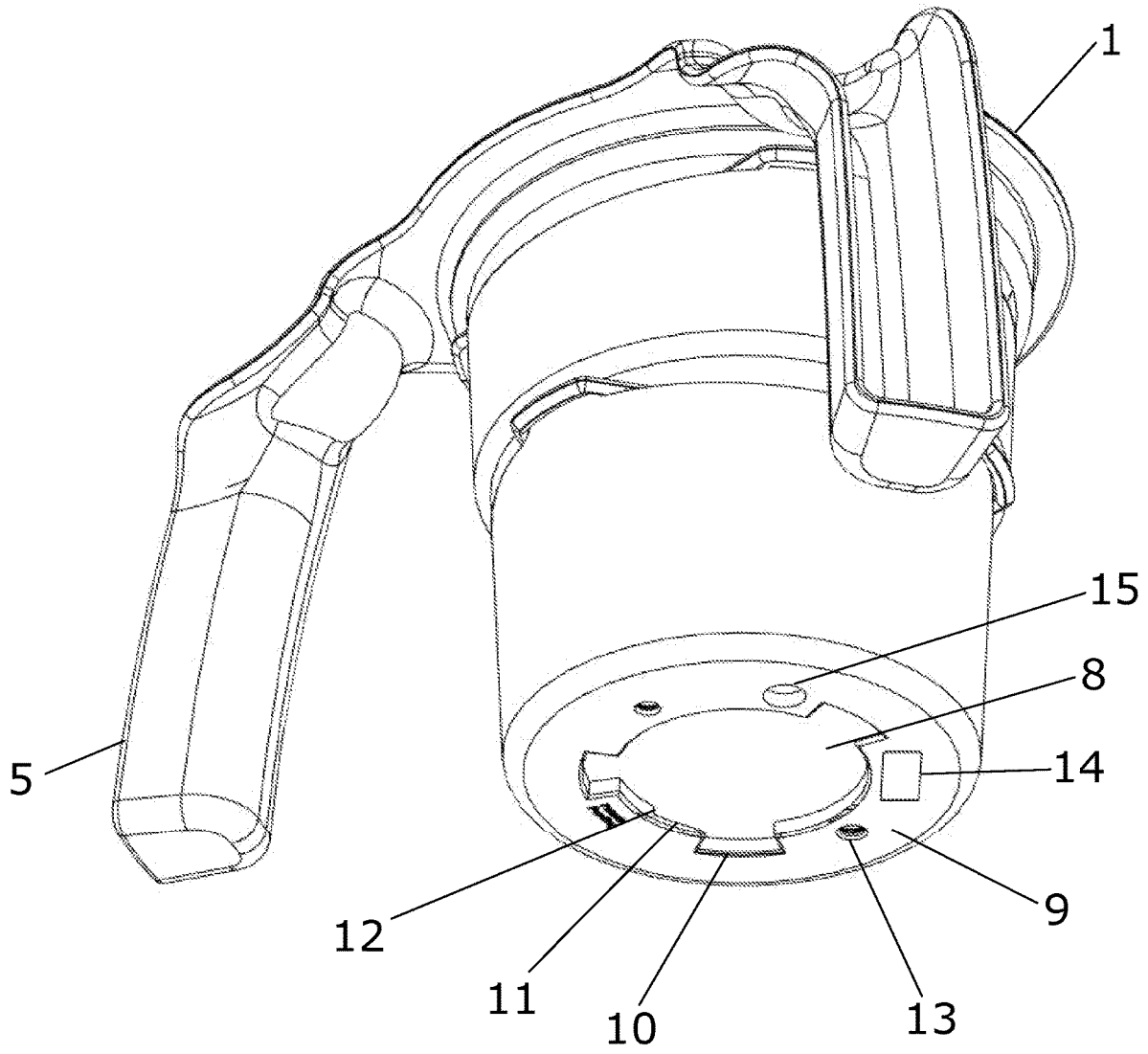
FIG. 2 is a bottom perspective of the assembly of FIG. 1, showing the shell with the handles and the accessory mounting assembly, all common to all embodiments.

One embodiment of the receptacle is illustrated in FIG. 1 (top perspective) and FIG. 2 (bottom perspective). FIG. 1 assumes the receptacle is sitting in a resting position on a horizontal surface, such as a table. The receptacle structure includes a shell (1) made of a rigid material, e.g., a thermoplastic, such as Polypropylene (PP), and inner bands (2) made of a flexible and elastic material, e.g., a thermoplastic such as acrylonitrile butadiene rubber (Buna-N). However, the shell (1) may also be made of any suitable material that provides sufficient structural stiffness without fracturing, such as acrylonitrile butadiene styrene (ABS), High Density Polyethylene (HDPE), Polyvinyl chloride (PVC), polycarbonate, metals including aluminum, ceramic, or wood. Possible other materials for the flexible bands (2) include thermoplastic elastomer (TPE), thermoplastic polyurethane (TPU), rubber, silicone, or suitably coated elastic. The material(s) from which the one or more bands may be made may be selected so that the band(s) may perform two functions, which may be independent. A first function may include flexing outwardly to receive a container when inserted into the receptacle, and thus providing an inwardly directed force against the container, which may be partially or entirely radial in direction. A second function may include generating static and dynamic frictional forces between the band(s) and an external surface of the container, which may assist in holding the container in the receptacle and inhibit or prevent motion of the container relative to the band(s) and/or the receptacle.

In a preferred embodiment, the shell (1) is near cylindrical in shape, being wider at the top and narrowing toward the base. This change in diameter of the shell is sufficient to allow the bottom of one shell to be inserted into the top of a second shell by a sufficient amount to be stable when carried. It is possible for the shell to be of another polygonal shape, such as square, pentagonal, hexagonal, or irregular in layout, so long as it can accept and retain beverage containers of many sizes and shapes.

The flexible bands (2) are prevented from moving vertically by being retained in a series of slots (3), which may be horizontal, arranged in a circular pattern around the vertical axis of the receptacle. These slots (3) are separated from each other by a series of posts (4), which may be part of the shell (1) or may be separate structures. Furthermore, there may be additional series of slots and posts at different levels along the vertical axis and aligned such that the bands are parallel in a preferred embodiment, that is, there may be two or more sets of horizontal slots (3), each set of horizontal slots being vertically spaced from another set of horizontal slots.

In a preferred embodiment each flexible band (2) is placed on the outside of the shell (1) and located at the level of one of the slots (3). The band (2) contracts inward and deforms to a linear orientation such that it passes through the interior of the shell (1) from one end of the slot (3) to the other. The band (2) exits the slot (3) and deforms to follow the exterior of the shell (1) to pass outside of and over the post (4) and into the adjacent slot (3), repeating the process. The post (4) prevents the band (2) from contracting completely and falling into the receptacle. The band(s) (2) may be sized so that, when positioned within the slot(s) as described herein, the band is at least slightly in tension, and therefore slightly elongated because of the elasticity of the band.

With each band (2) passing into the interior of the receptacle (1) and passing over the exterior of the posts (4) it is restricted from moving upward or downward. If the band (2) is forced vertically the upper or lower edge of the slots (3) retaining it will prevent its movement, and the band (2) will deform in the direction of force applied.

Attached to the outside of the shell (1) is a plurality of grips or handles (5), though two is the preferred number. In the preferred embodiments these handles may be placed at an included angle less than 180 degrees apart such that they closely align with the user's arms, and may point to the center vertical axis of the shell (1) when gripping them. The handles (5) may be nearly perpendicular to the surface of the table when the receptacle is in the resting position, thus making them easily held by a person using two hands.

The handles (5) may be attached to the outside wall of the shell (1) via one or more handle bridges (6). In embodiments the handle bridge (6) may be positioned only at the top of the handle (5), and may be contoured with a thumb indentation (7) to give the user a more stable and comfortable grip. The bridges (6) place the handles sufficiently far enough from the shell (1) to permit an end-user to comfortably insert his or her hands between the shell (1) and the handles (5) and firmly grasp the two handles (5) simultaneously.

FIG. 2 shows a bottom perspective of the receptacle, as though viewed through a clear table while it is in the resting position. This view clearly shows a drainage port (8) generally formed in the center of the bottom of the shell (1). The drainage port (8) permits any liquid spilled into the receptacle from collecting in the bottom where it might be spilled onto the user when the receptacle is tipped for beverage consumption, and it enables the receptacle to be washed in, e.g., an automated dishwasher in an upright or inverted orientation without water pooling inside.

Also visible in FIG. 2 is an accessory mount assembly (9), including at least one, and advantageously a plurality of tab slots (10), tension ramps (11), tab stops (12), and accessory screw holes (13). These slot-ramp-stop groups may be spaced at approximately, though not exactly, equal distances along a ring with the center of the ring in the center of the shell (1). This irregular distribution of the slot-ramp-stop groups forces any accessory to be attached in only one orientation with respect to the handles (5), ensuring the accessories that require specific orientation with respect to the end-user may be properly aligned every time. Also shown is an accessory lock dimple (15) that allows an accessory locking pin (22, not shown) to engage the dimple (15) and inhibit or prevent the accessory from disengaging. A detailed description of the accessory mounting system appears elsewhere herein.

FIG. 2 further depicts one or more shallow label recesses (14) on the bottom of the shell (1). In embodiments, a single opening may accept either a serial number or barcode identification label or a holographic type "proof of authenticity" label. Other possible uses are date codes, date code labels, part numbers, or user applied asset tags.

Figure 3:
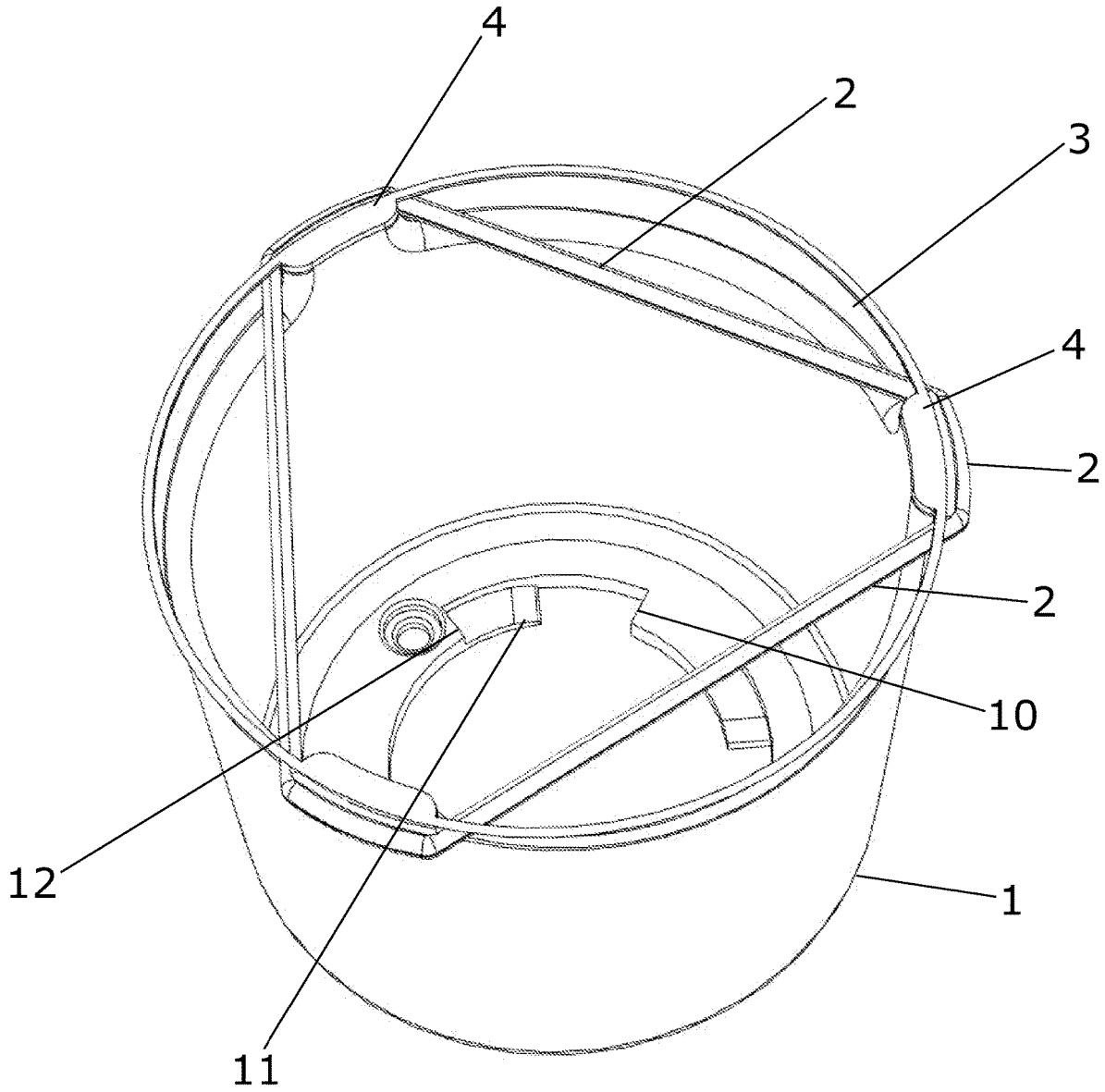
FIG. 3 shows a perspective view of the assembly with the shell cut away to just above a bottom flexible band, showing the band retained by posts and passing through slots.

FIG. 3 shows a cutaway view of the shell (1) made just above a series of slots (3) and posts (4). This view shows a flexible band (2) as it passes through the interior of the shell (1) and around the posts (4). Also shown are components of the accessory mounting system, including a tab slot (10), tension ramp (11), and tab stop (12).

Figure 4:
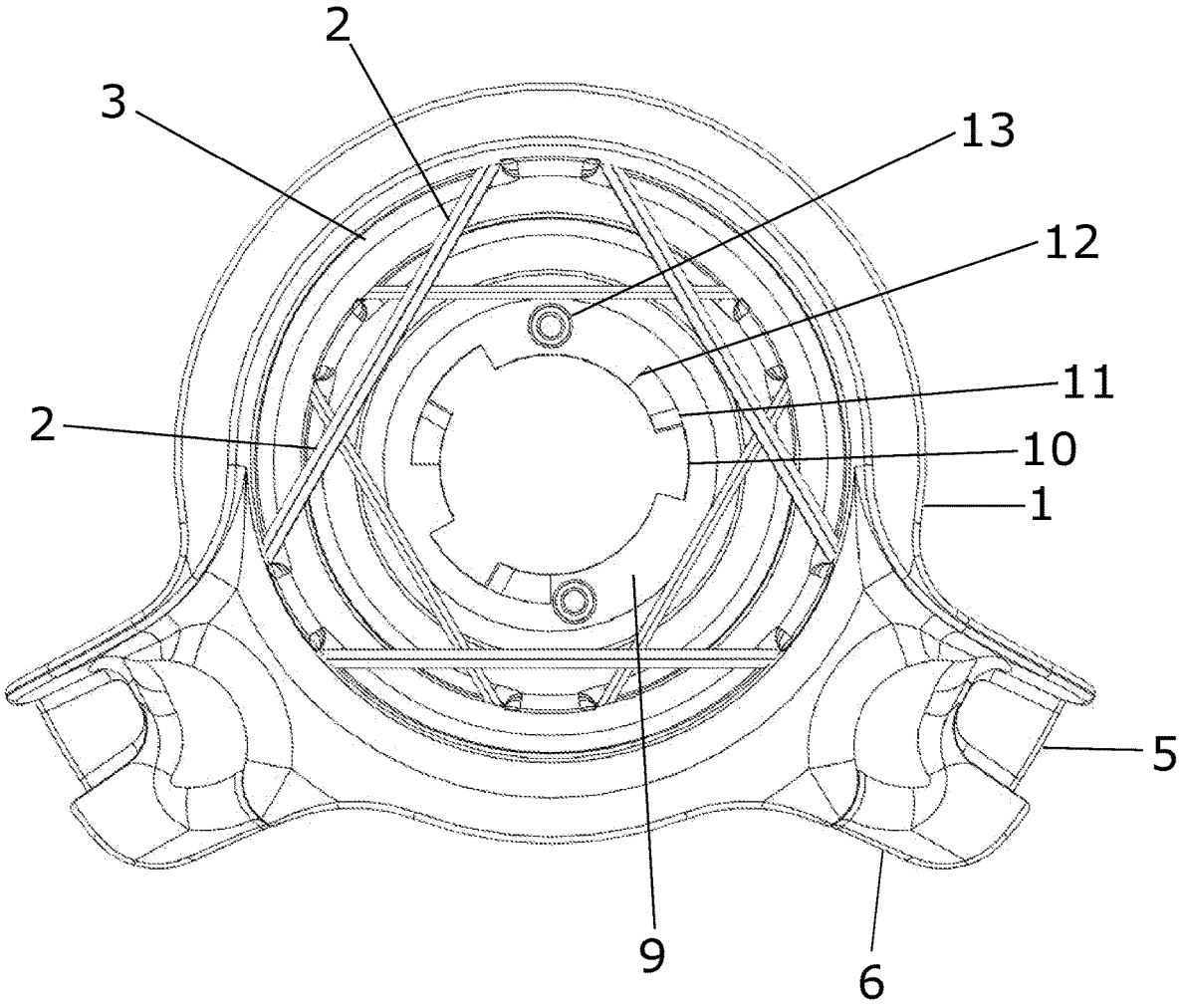
FIG. 4 is a top view showing the shell, the handles, the bands, and the inside view of the accessory mounting assembly.

FIG. 4 is a top view of the receptacle. At the center is the inner view of the accessory mount (9). This view shows the not quite uniform spacing of the tab slots (10) in a circular pattern about the center of the base. This forces all accessories (not visible) to have a definite, single orientation with respect to the handles (5) and handle bridges (6) of the receptacle. Such an arrangement means that accessories that require a specific orientation with respect to the user can be guaranteed. An example of such an accessory might be an active stability control base.

The three remaining components of the accessory mount (9) are also shown in FIG. 4. Each tab slot (10) has a corresponding tension ramp (11) and tab stop (12), so that when an accessory includes a tab (19, not shown) that fits into a tab slots (10), and the accessory is rotated about a vertical axis relative to the receptacle, the accessory's tab (19, not shown) slides up the tension ramp (11) until further rotation is prevented by the tab stop (12). Semi-permanent accessory attachment is possible using the one or a plurality of accessory screw holes (13), though a preferred embodiment includes only two. A complete description of the accessory mounting system appears elsewhere herein.

Also shown in FIG. 4 are two flexible bands (2) of an embodiment. The bands are visible in the interior of the shell (1) where they pass through the slots (3) in the shell (1). In embodiments, the bands (2) are oriented such that the bands form a hexagonal shape, approximating a circular pattern. This may be important to securely retain a beverage container inserted into the receptacle. Each of the bands (2) may take any of a number of shapes, including circular or an approximate triangle shape, with the posts (4) forming the points when it is triangular. As illustrated in the example of FIG. 4, each band (2) may include one or more shorter, straight sections interposed between and joining together the three longer, straight sections of a "triangular" band. The length of each shorter section may be the same length as, or slightly longer than, the outer (e.g., circumferential) length of each post (4).

Figure 5:
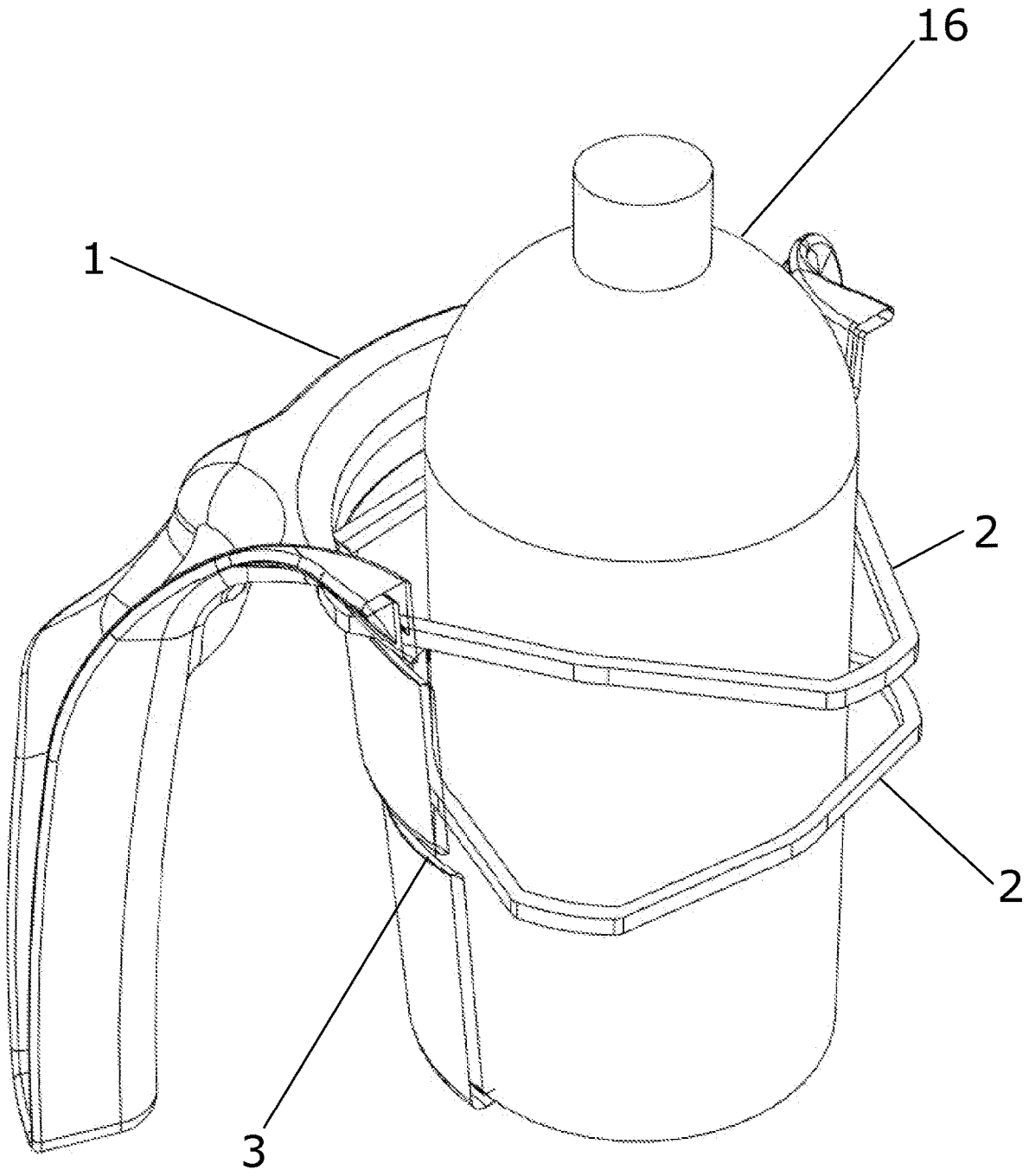
FIG. 5 is a cutaway perspective view showing the assembly with a sample container inserted and deforming the flexible bands of a preferred embodiment.

FIG. 5 shows a perspective view with a portion of the shell (1) cut away and with an exemplary beverage container (16) inserted therein. The shell (1) contains the flexible bands (2) that have been elastically deformed outward by the sides of the beverage container (16). The bands (2) take on the approximate shape of the exemplary container and create radial tension against the outer walls of the container, i.e., a radially inward directed force. In embodiments the two bands (2) pass through three slots (3) each on two different but parallel, vertically spaced planes. These slots (3) create polygons which are angularly offset along the vertical axis, creating six unique compression points along the exterior surface of the container (16) (three for each band).

Figure 6:
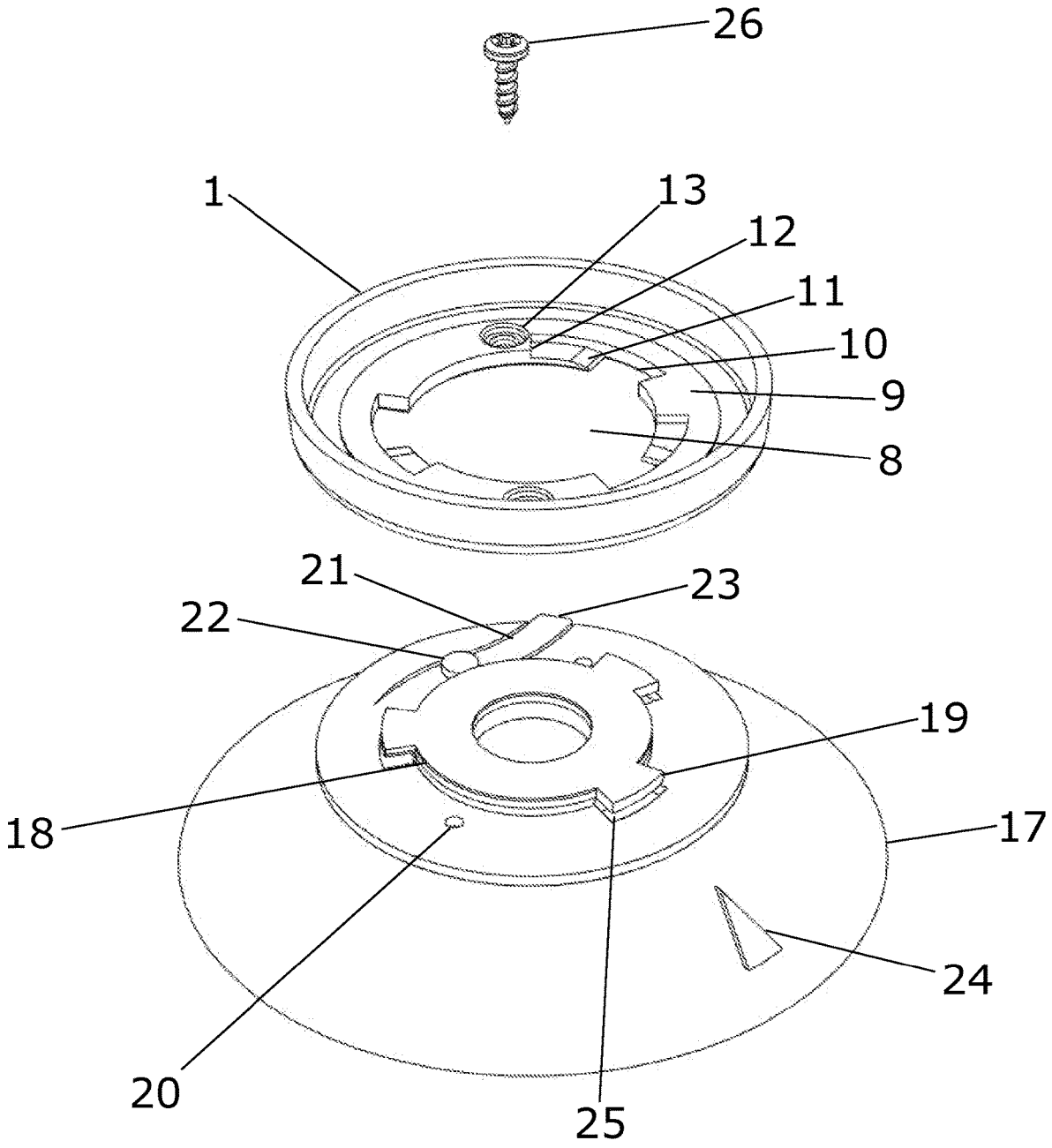
FIG. 6 shows an exploded view of an exemplary receptacle with only the bottom of the receptacle visible, as well as an exemplary accessory, and shows the relationship between the accessory mount assembly on the receptacle and the matching components on the accessory.

FIG. 6 shows an exploded view of portions of the shell (1) at the base. Within this cutaway the accessory mount assembly (9) is visible in the center. This assembly may include a plurality of tab slots (10) with associated tension ramps (11), and tab stops (12). In embodiments there may be three of these sets, although one or two, or more than three, can be used.

Pictured beneath the cutaway shell base (1) is a sample accessory (17). At the top of this or any other accessory is an accessory mounting ring (18). The ring (18), regardless of the accessory, is standardized to match the standardized accessory mount assembly (9) on the receptacle, fitting into the drain hole (8), and it may include a plurality of tabs (19), three in the preferred embodiment, but matching the number of tab slots (10) in the base. The tabs (19) are spaced apart and elevated from the top of the accessory, each forming a gap (25) therewith, by an amount slightly more than the maximum thickness of the tension ramp (11) on the receptacle. The tabs (19) may also be positioned to align with the tab slots (10) on the bottom of the receptacle (1), allowing them to pass through the tab slot openings. The accessory (17) can be any of a number of devices, including a suction foot, a heavily weighted base, or the like.

Other optional bases include, but are certainly not limited to:

1. Wide Base—Makes it harder to tip over when stationary.
2. Weighted Base—Reduces receptacle motion when held by a person whose hands shake.
3. Weighted Wide Base—Combination of the two above.
4. Colored Ring—Allows for attachment of different colored rings to differentiate between otherwise identical receptacles. Each user can have his/her own receptacle.
5. Active Stability Base—Gyroscopic stabilization for persons with severe hand shaking or palsy. In this accessory a small gyroscope will be placed in the housing and powered by a rechargeable battery. It may be activated by a support staff or turn on automatically as a switch on the bottom of the accessory base is activated when the user picks up the receptacle-accessory assembly.
6. Spill Alarm Base—If the receptacle goes from vertical to horizontal with no corresponding vertical movement, an alarm will be triggered. This may be audible, visual, or a signal sent (e.g., via radio waves, e.g., WiFi, Bluetooth, and other near-field communications) to a monitoring station, a cell phone app, or the internet to be relayed to the appropriate caregiver. This base will use a three axis accelerometer and microcontroller to determine the receptacle-accessory assembly's orientation and position. If the orientation changes by more than a predetermined amount and without the assembly also moving through space in an upward direction, the microcontroller will provide an audible and/or visual alarm or craft a message to be sent via wireless means.
7. Pager Base—A button will be placed on the base so that if the end-user (patient) needs assistance it will signal a monitoring station or a cell phone app, or send a message to an internet receiver that is the relayed to the appropriate staff member or caregiver (e.g., via radio waves, e.g., WiFi, Bluetooth, and other near-field communications).
   This base will also use a microcontroller to monitor a switch on the base and when pressed for a predetermined amount of time it will craft a message to be sent via wireless means.
8. Vital Signs Sensor Base—The base will include electronics hardware and/or software modules which are configured to collect data from a sensor placed along the outside of one or more handles. Such data might include temperature, heart rate, oxygen levels, or even glucose levels. This data may be sent in real-time to an internet receiver for collection and forwarding to the appropriate caregiver staff (e.g., via radio waves, e.g., WiFi, Bluetooth, and other near-field communications).
   In this accessory one or more sensors may be placed on one or more of the handles to collect biometric data from the user's hands. This data will be relayed to a microcontroller in the base for signal processing and analysis. The results will then be crafted into a message to be sent via wireless means.
9. Timing Base—Senses when the user picks up the receptacle to consume the beverage and reminds the user to drink if the period since the previous drink is too long. Notification may be lights and/or sounds. Interval can be set via the device or by radio waves (e.g., WiFi, Bluetooth, and other near-field communications) and the base can report back consumption patterns to an app or the internet.

A three-axis accelerometer may be placed in the base and the motion of the receptacle-accessory assembly may be monitored. If the position of the assembly does not change sufficiently or in the proper direction the audible or visual alerts will be activated by the microcontroller and/or a message may be crafted to be sent via wireless means.

10. Consumption Sensing Base—More sophisticated version of the timing base. Uses pressure sensors in the base to constantly weigh the entire assembly to accurately determine the rate of consumption and feed this data in real-time to a monitoring system that can alert staff if the rate is too low or too high. This base will contain a pressure sensor on the bottom of the base that is connected to a microcontroller. The microcontroller will monitor the force of the receptacle-accessory assembly on the table and note its rate of change. If the rate falls below or rises above a predefined amount the microcontroller will craft a message to be transmitted by wireless means.

FIG. 6 also shows an optional accessory mount locking mechanism (21). The mechanism (21) may include a pin (22) extending upward from the mechanism (21) and a release extension (23) at one end of the mechanism (21) and extending outward from the outer edge of the optional accessory base (17). The release extension (23) may be a simple lever attached to, or formed from part of, the base (17), which may extend outward so that a free end of the lever is accessible to a user to press. The pin (22) is positioned such that when the accessory base (17) is inserted onto the bottom of the shell (1), and rotated into its stop position, the pin (22) will extend into a dimple (15) on the bottom surface of the shell (1). When the release extension is a lever, the lever deflects downward until the pin (22) is positioned in the dimple (15), at which point the lever at least partially, or entirely, returns up to its resting position because of the inherent elasticity of the material of the lever where it meets the base (17).

Figure 7:
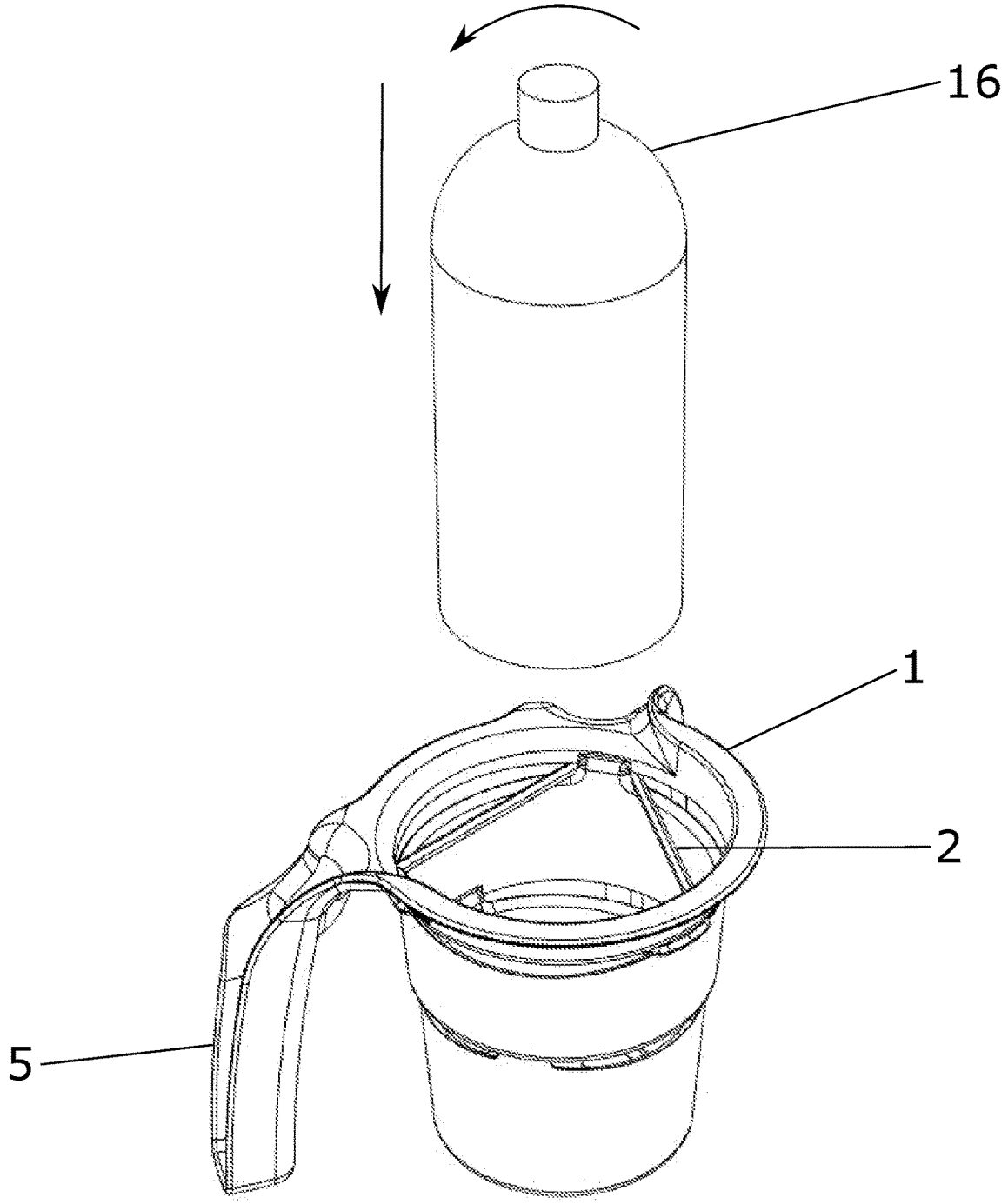
FIG. 7 shows the basic operation of inserting a container into the receptacle.

The manner of using the beverage container receptacle is similar to that for using certain types of automotive cup holders. As shown in FIG. 7, a beverage container (16) is centered above the receptacle shell (1) by a caregiver and he or she optionally grasps the handle (5) to stabilize the receptacle and keep it from rotating. The person then grasps the beverage container (16) near its top and simultaneously pushes the container downward into the receptacle shell (1) while twisting it clockwise or counterclockwise until it contacts the bottom of the receptacle.

Upon insertion of the beverage container (16) into the receptacle the flexible bands (2) will deform outward toward the inner wall of the shell (1), applying an inward force on the container (16) to stabilize the container by creating static friction to inhibit, and advantageously prevent, the container from sliding out of the receptacle when it is tilted more than 90° from vertical.

Figure 8:
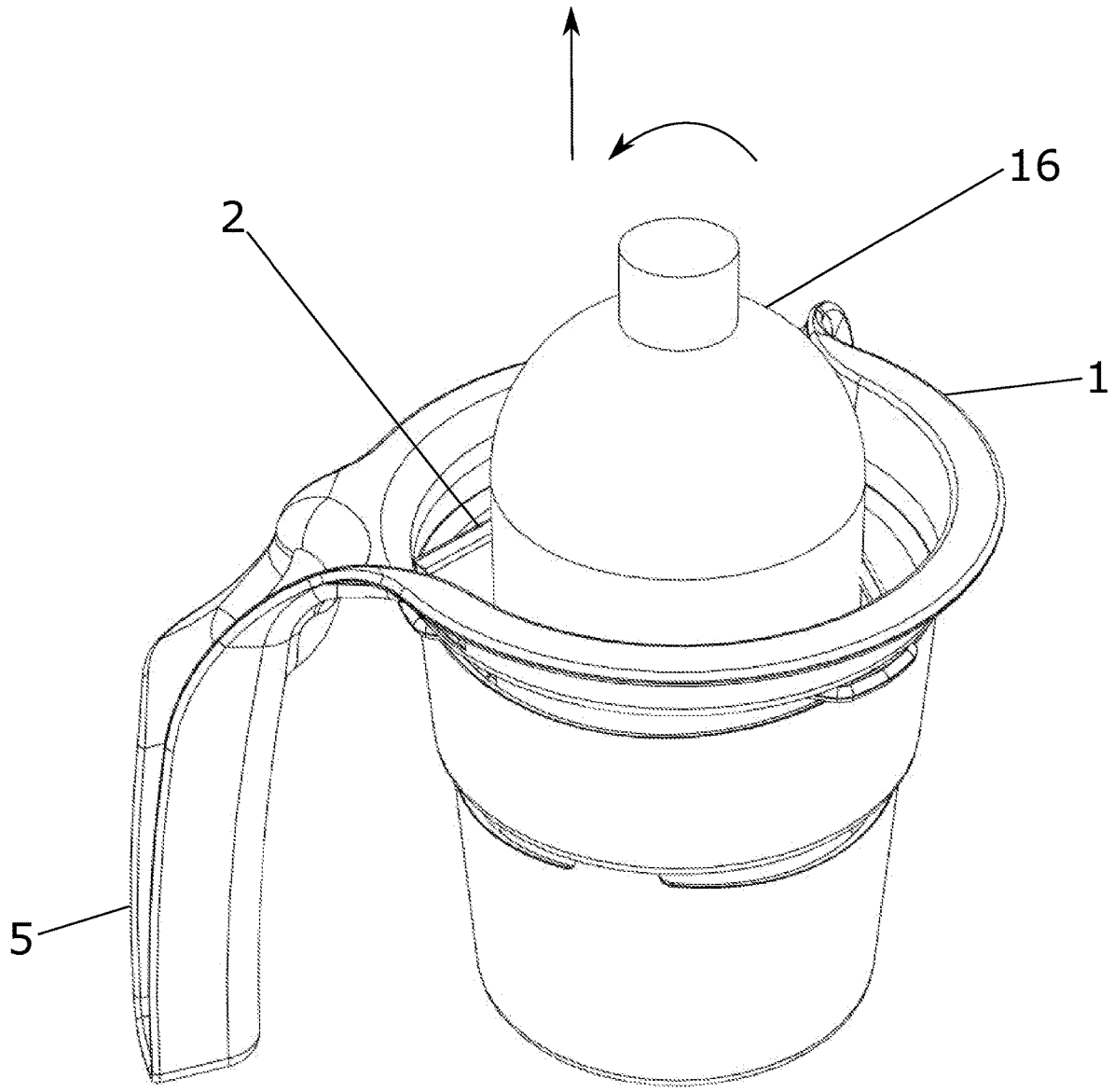
FIG. 8 shows the operation of removing a container from the receptacle.

FIG. 8 shows a procedure to remove any beverage container from the receptacle. To accomplish this, the caregiver optionally grasps a handle (5) on the receptacle with one hand and the container (16) near the top with the other hand. This person then holds the receptacle stationary while twisting the container (16) in the same direction as when inserting it (counterclockwise in the illustration) and simultaneously pulling upward on the container (16) until it clears the flexible bands (2).

FIG. 6 also shows a relationship between accessory mounting assembly (9), in the base of the receptacle shell (1), and the accessory mounting ring (18) on the top of the accessory. In operation the caregiver will align the tabs (19) of the accessory mounting ring (18) with the tab slots (10) in the base of the receptacle shell (1). These slots and tabs are not uniformly spaced in a ring such that they can only be aligned in a single orientation. To facilitate this aligning step, optional visual and/or tactile indicia (24) are formed on the outer surface of the accessory base (17), such that when a specified (left or right) handle (5) of the shell (1) is positioned to align with the indicia formed on the accessory base (17) the tabs (19) will be aligned with the tab slots (10) prior to the insertion of the tab(s) into the slot(s).

The accessory tabs (19) are inserted upward into the aligned tab slots (10) and the caregiver rotates the accessory base (17) with respect to the shell (1) base and accessory mount assembly (9). In this illustration, the person would rotate the receptacle clockwise when viewed from the top. The tabs (19) contact the tension ramps (11) which guide the tabs upward onto the flat portion of the ramp. At the end of the ramp the tabs (19) encounter the tab stops (12) preventing the accessory from rotating any farther. In embodiments, the tabs (19), ramps (11), and tab stops (12) may be oriented for counterclockwise, instead of clockwise, rotation and locking.

Once the accessory base (17) has been rotated into place, the caregiver may semi-permanently secure it to the shell (1) base, if desired, by inserting a plurality of screws (26) through the accessory screw holes (13) in the accessory mount assembly (9) and into the accessory screw ports (20) on the top of the accessory base (17). The holes (13) in the shell (1) permit the screw (26) to pass freely but the ports (20) in the accessory are sized such that the screws must be driven into place, making a semi-permanent union.

Should the user desire to permanently attach the accessory, a layer of adhesive may be placed on top of the accessory base around the accessory mounting ring. As the accessory is rotated and the tabs (19) slide up the ramps (11) the adhesive will be sandwiched between the base of the shell (1) and the top of the accessory base (17), enabling a permanent bond.

For accessories that are to be added and removed on a more regular basis, the accessory may be equipped with one or more accessory locking mechanisms (21), shown in FIG. 6. To attach the accessory base (17), the caregiver aligns the shell handle (5) with the indicia (24) on the side of the accessory base (17), pushes the tabs (19) through the slots (10), and rotates the accessory base (17) as described above until the locking pin (22) of the locking mechanism (21) slides into the dimple (15, not visible) on the bottom of the shell (1). When the accessory mounting ring tab (19) encounters the tab stops (12), the pin (22) will simultaneously drop into the dimple (15, not visible).

Since the accessory locking mechanism (21) pin (22) has vertical walls, it cannot be backed out of the dimple (15, not visible) in the base of the shell (1) by simply twisting in the opposite direction used for attaching. To remove the accessory base (17), the caregiver must push down on the accessory lock release extension (23) while simultaneously rotating the receptacle in the opposite direction as used when attaching it (in this illustration counterclockwise viewed from the top).

Additional Exemplary Embodiments

While a first exemplary embodiment described above may be suitable for many applications, other possible variations may accomplish similar goals. For example, there may be more or fewer sets of horizontally aligned slots (3), e.g., 1 or 3, 4, 5, and so on.

Figure 9:
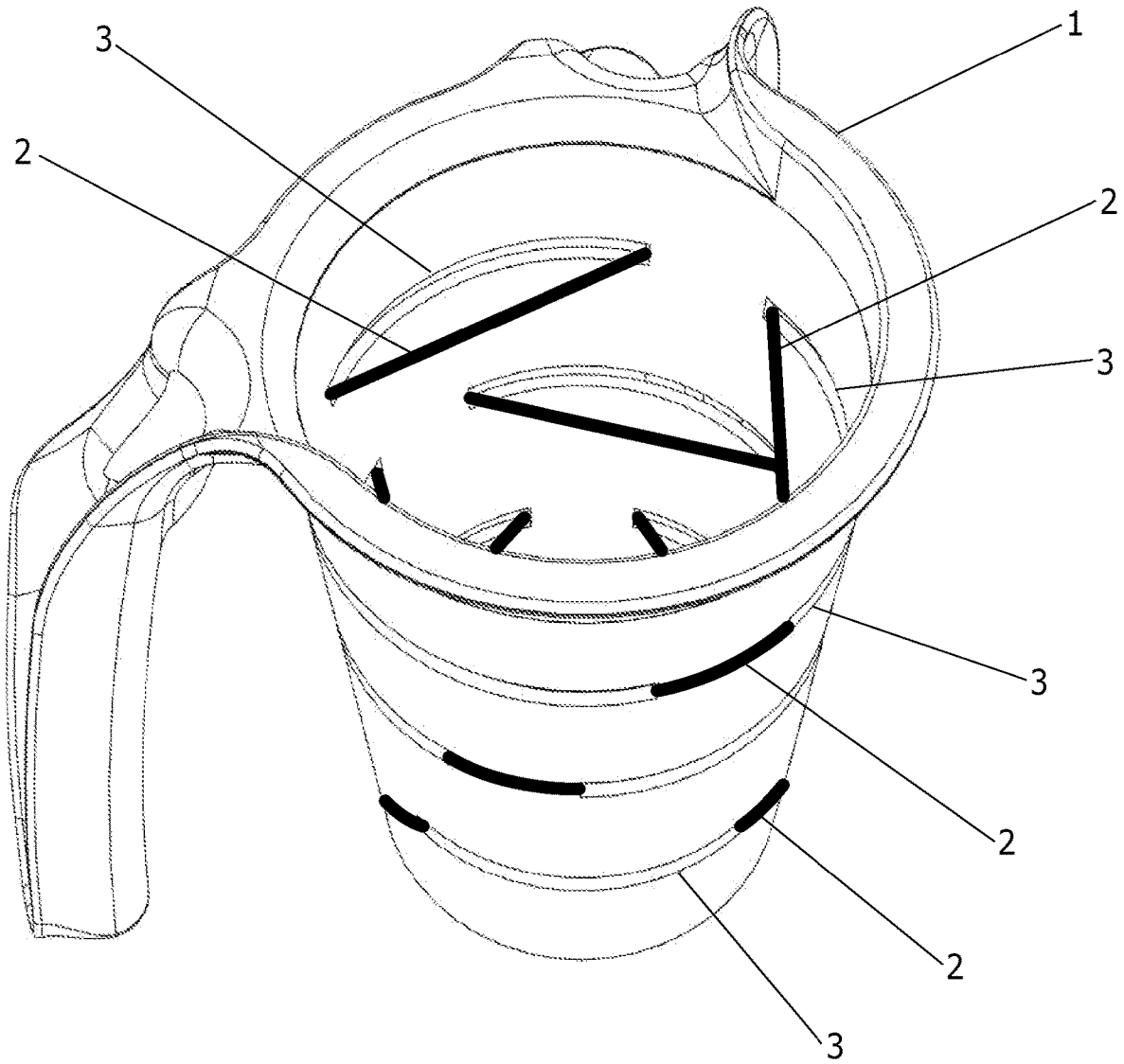
FIG. 9 shows another embodiment utilizing three flexible bands.

FIG. 9 shows a receptacle with three vertically spaced sets of slots (3) and a third flexible band (2). In this embodiment the third band (2) is placed such that the segments of the band passing through the center of the shell (1) do not align with either of the previous two bands (2) in the preferred embodiment, thus more uniformly distributing inward pressure along the outer walls of the beverage container. The third band (2) may alternatively be aligned with one of the prior two bands (2) to reinforce retention in a given direction (vertically or horizontally when the receptacle is held horizontally in the consumption position). Additional bands (2) and slots (3) may be added at additional offset angles from the original bands (2) to apply further pressure to or redistribute pressure around the beverage container.

Figure 10:
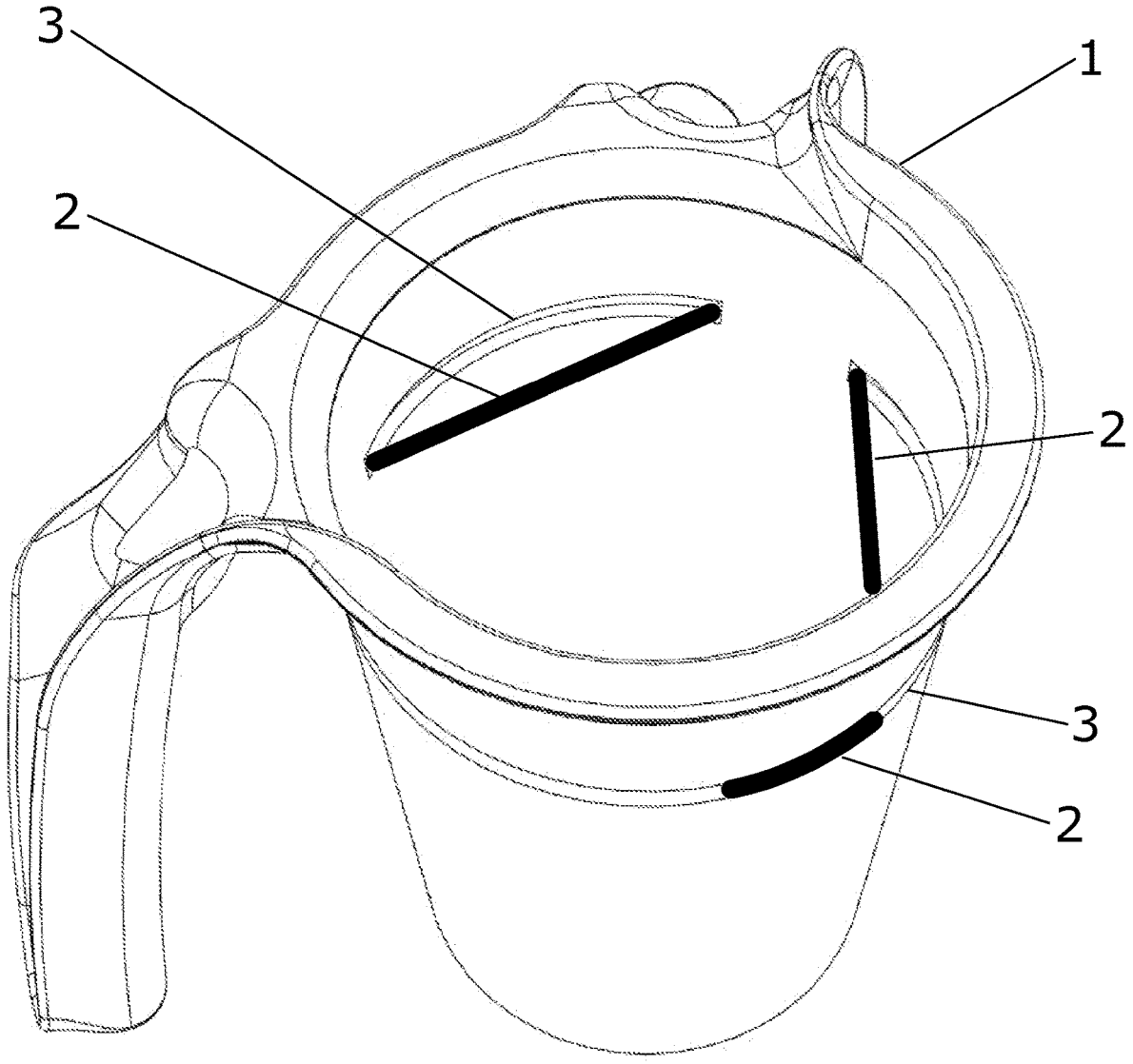
FIG. 10 shows another embodiment utilizing a single flexible band.

Alternately FIG. 10 shows an embodiment that utilizes a single flexible band (2) with three slots (3). In this embodiment the band prevents the beverage container from sliding out when the receptacle is tipped and aligns it within the receptacle near the top of the shell (1). The bottom of the beverage container is free to move slightly until it contacts the inner wall of the shell (1). Thus the various possible embodiments may use one or more flexible bands (3).

Figure 11:
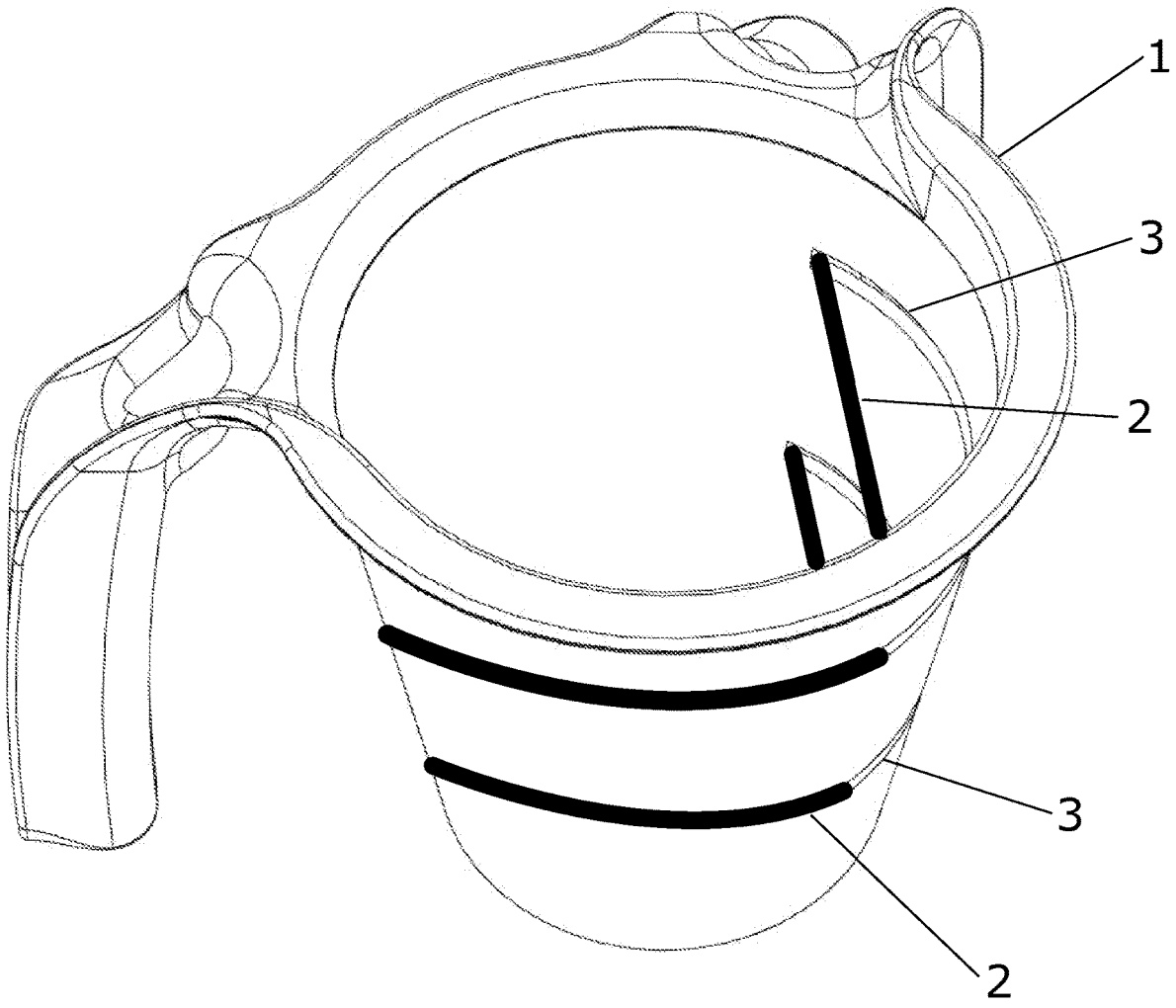
FIG. 11 shows another embodiment with two flexible bands utilizing a single slot each with the slots aligned.
Figure 12:
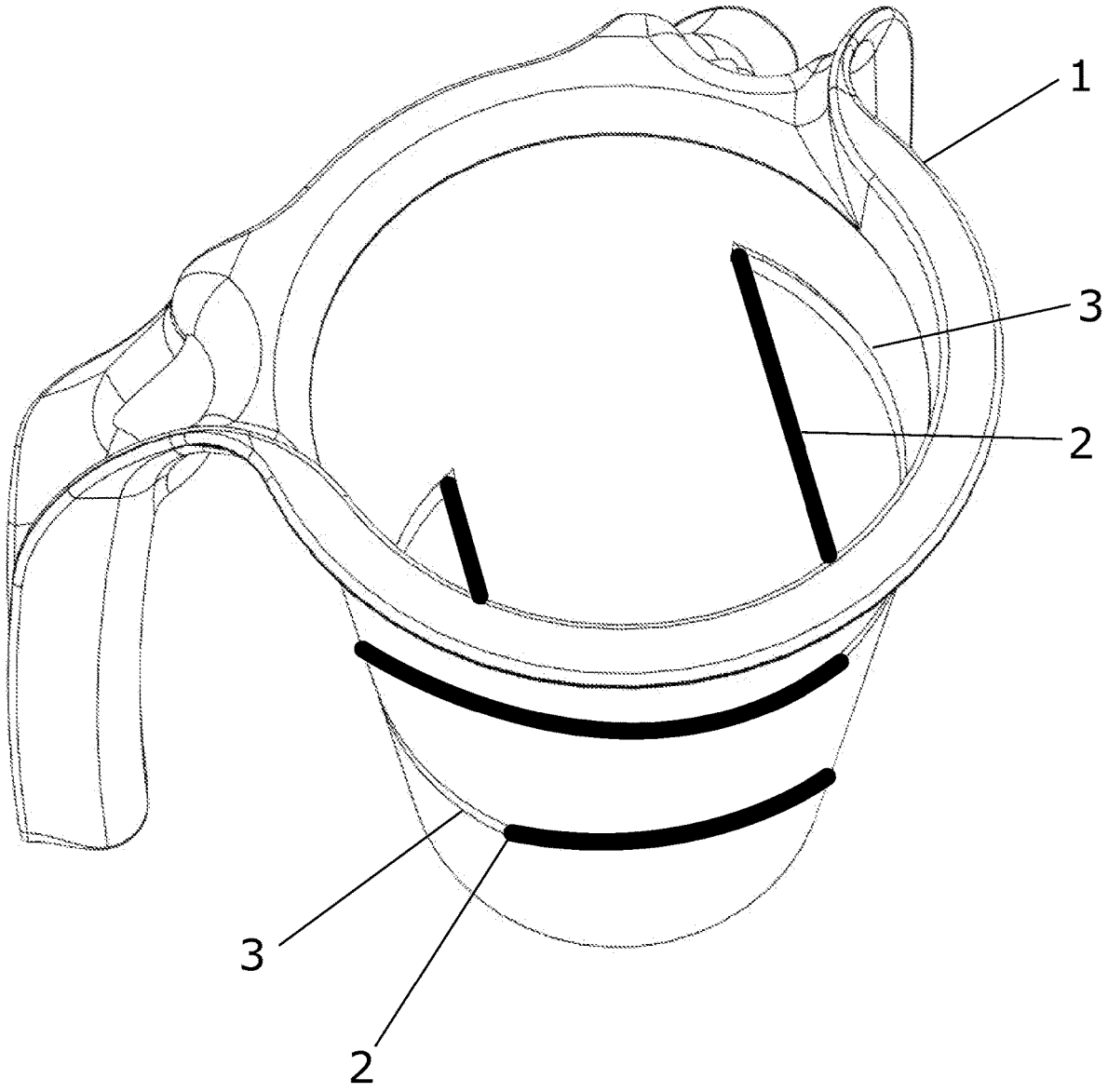
FIG. 12 shows another embodiment with two flexible bands and single slots each, with the slots offset from one another.

An embodiment utilizing fewer slots (3) per band (2) is shown in FIG. 11. In this embodiment each parallel horizontal band (2) passes through a single slot (3) and continues around the outside of the receptacle shell (1) back to its starting point. These bands (2) push the beverage container against the inner wall of the shell (1) as in FIG. 11, or the bands (2) may be placed to provide force toward other shell walls at another vertical level that angles the beverage container away from the vertical centerline, as shown in FIG. 12.

Figure 13:
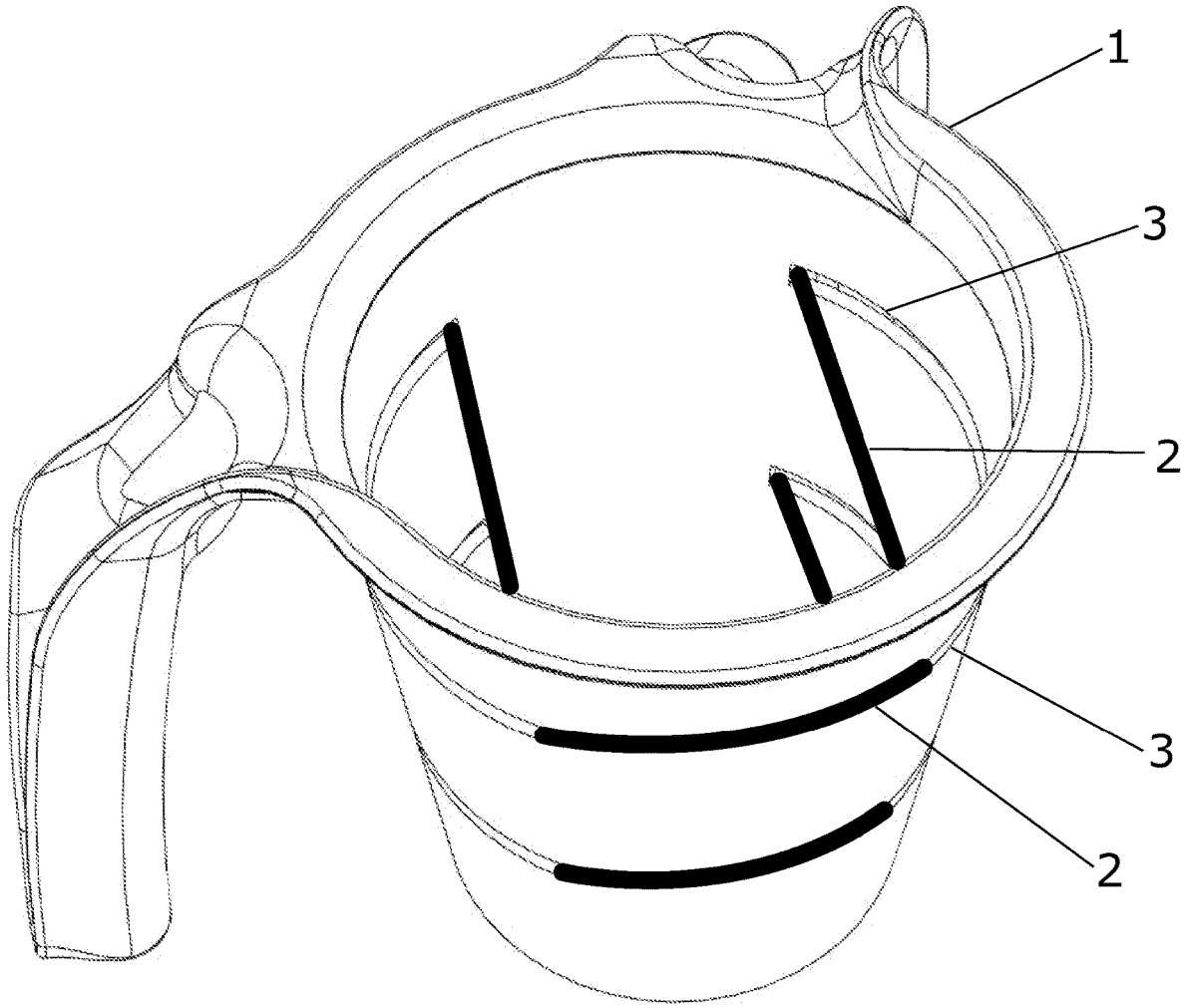
FIG. 13 shows another embodiment with two flexible bands, including only two slots per band.

A further variation includes an embodiment with two slots (3), spaced farther apart, as shown in FIG. 13. In this embodiment, the two parallel halves of one band (2) align the beverage container with the vertical centerline of the shell (1) in one direction, while one or more additional bands (2) placed at another vertical level (only one is shown) may be placed at offset angles to retain the beverage container in other directions.

Figure 14:
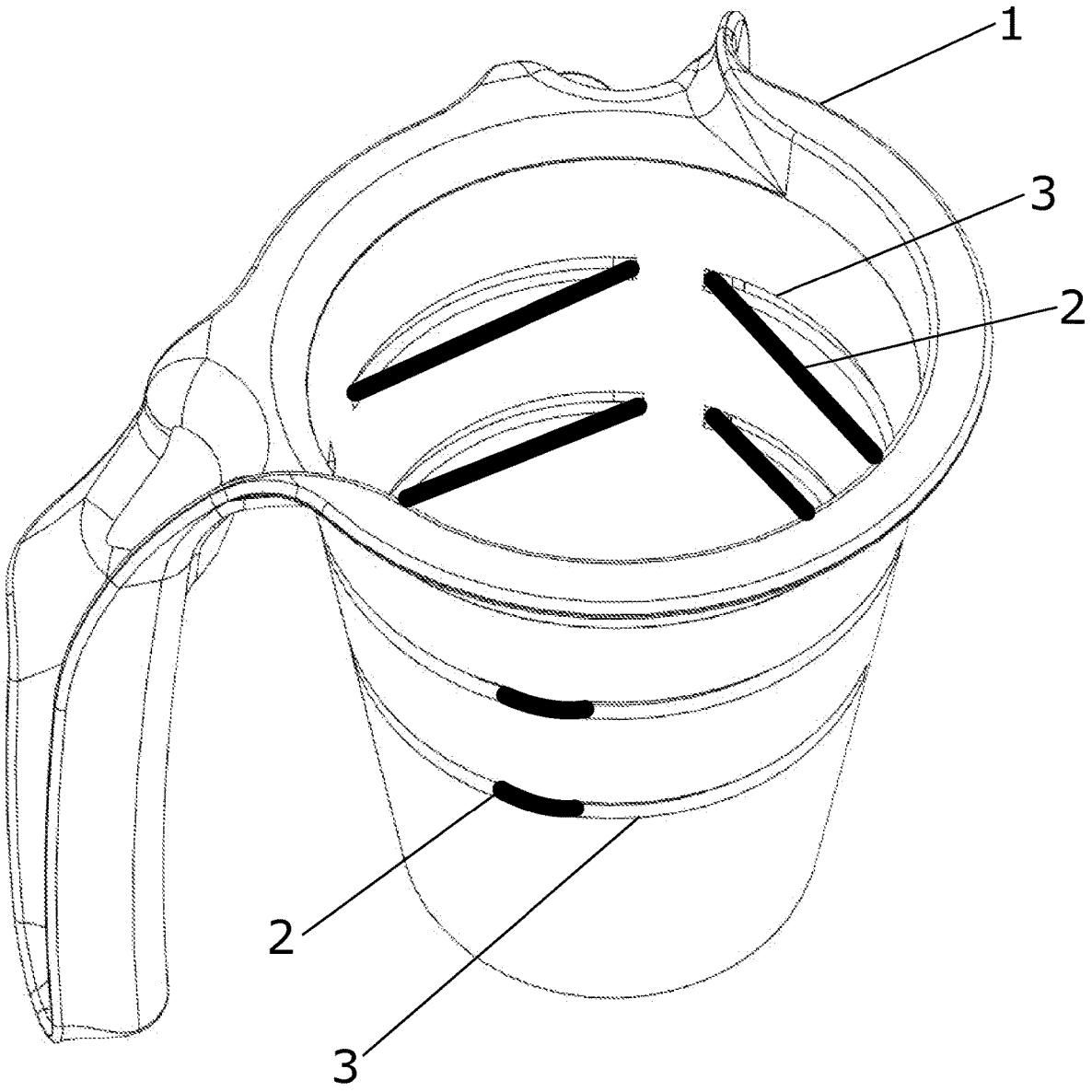
FIG. 14 shows another embodiment utilizing four slots per flexible band.

FIG. 14 shows an embodiment wherein more than three slots (3) are utilized per band (2). In this embodiment, the flexible bands (2) are shown passing over four retention posts (4), as opposed to the three in the preferred embodiment. This creates a rectangular band pattern as the bands pass through the center of the shell (1). Thus, it is possible that an alternative embodiment may utilize four or more slots (3) per band (2).

Figure 15:
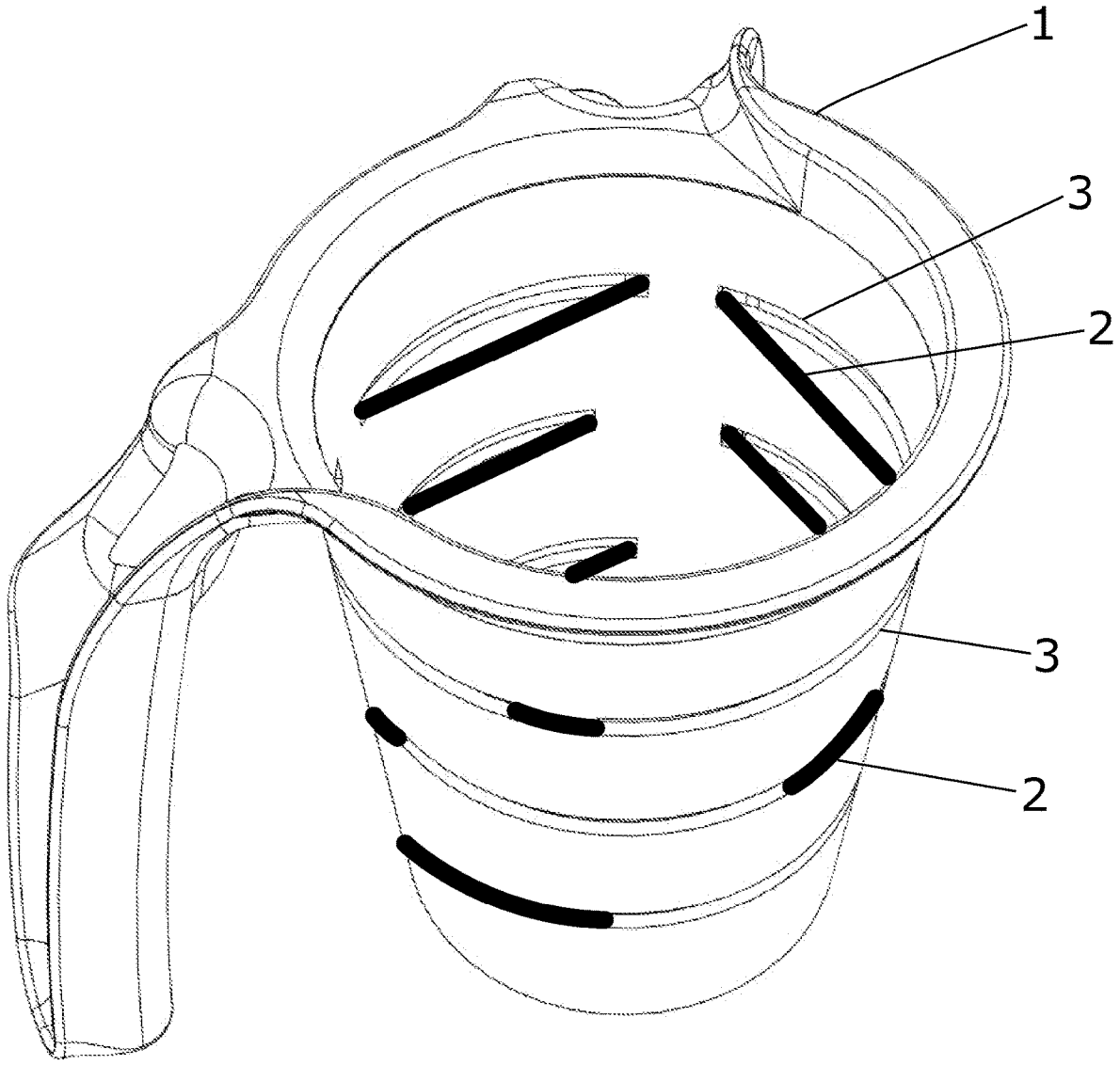
FIG. 15 shows another embodiment utilizing three flexible bands, with two, three, and four slots.

FIG. 15 shows a possible embodiment in which there are three flexible bands (2), but each has a different number of slots (3), in this case two, three, and four, but any combination of slot count and band count could be used.

Figure 16:
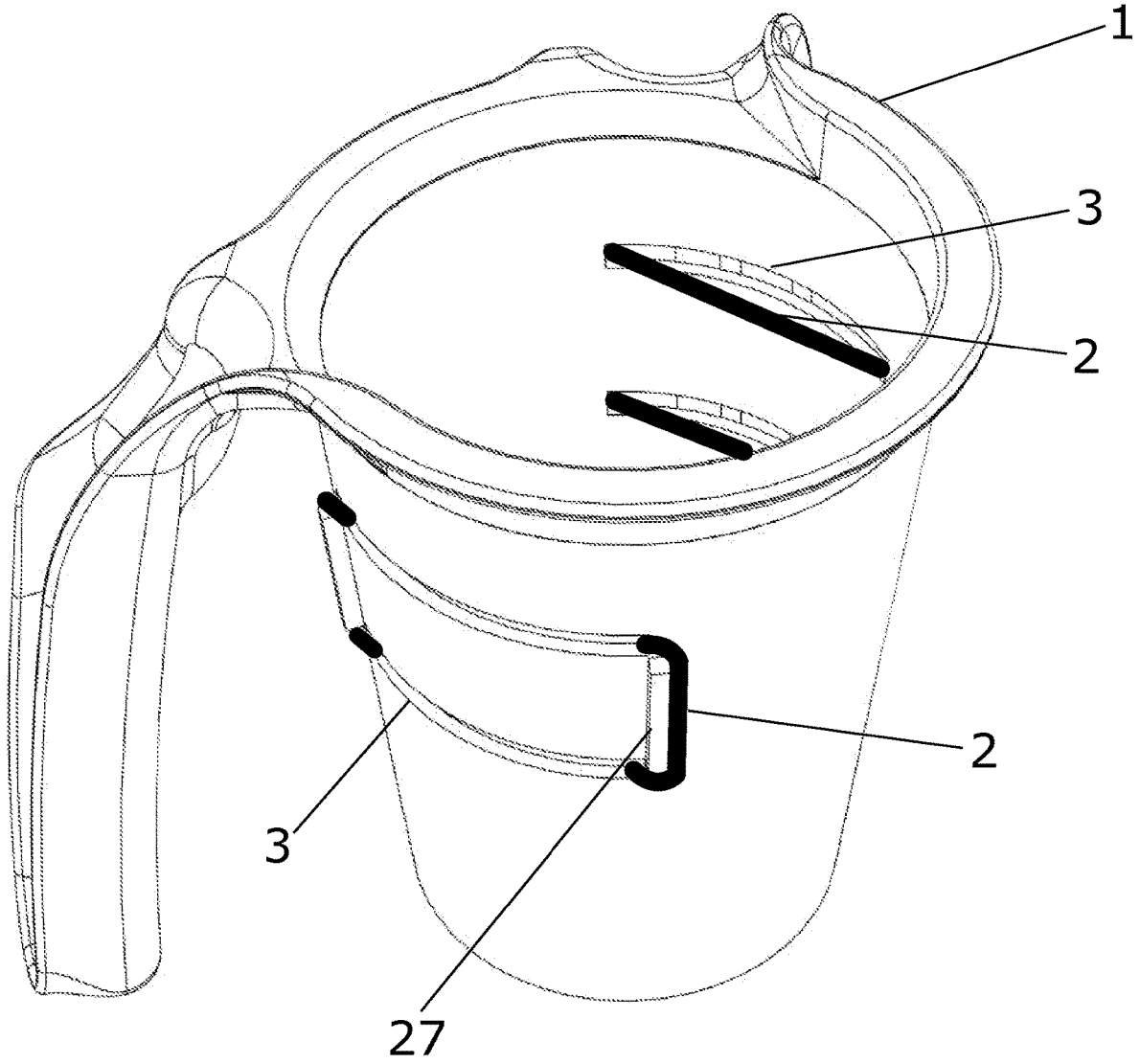
FIG. 16 shows another embodiment wherein bands are retained by posts on the exterior wall of the shell.

FIG. 16 shows an embodiment whereby the flexible bands (2) do not circumscribe the outer wall of the shell (1). In this embodiment the slots (3) are cut horizontally, but tabs or pins (27) are placed between two parallel sets of slots (3) at the ends of slots, and may be located on an exterior surface of the shell (1). As the flexible bands (2) pass out of the slots (3) they loop over the tabs or pins (27) and reenter the adjacent slot (3). As with other embodiments described herein, there may be one or more bands (2) and one, two, or more slots (3) in pairs in any variation of this embodiment.

Figure 17:
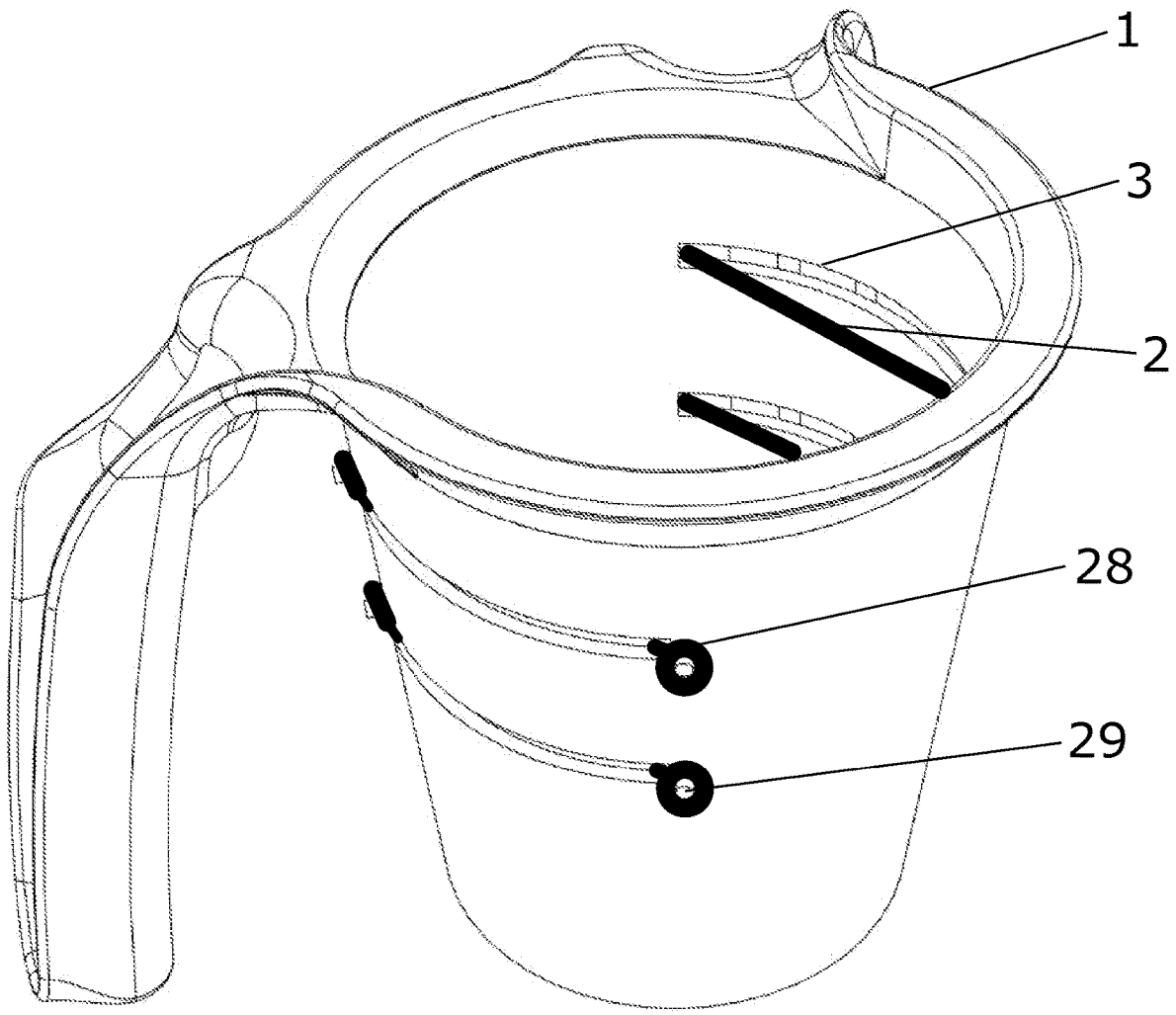
FIG. 17 shows another embodiment utilizing linear flexible bands with rings at each end that attached to posts on the exterior wall of the shell.

Another alternative embodiment is one in which the flexible bands (2) do not circumscribe the outer wall of the shell (1), as shown in FIG. 17. In this embodiment each flexible band (2) is linear with a retaining element (28), which may be a ring, hook, or the like, at each end. The retaining element (28) at each end of the bands (3) is placed on a peg or hook (29) on the exterior of the shell (1) just outside the end of the slot (3) in which the band (2) will be placed. The band (2) is stretched across the gap in the slot (3) as in the preferred embodiment and the ring (28) at the opposite end is placed on another peg or hook (29).

Figure 18:
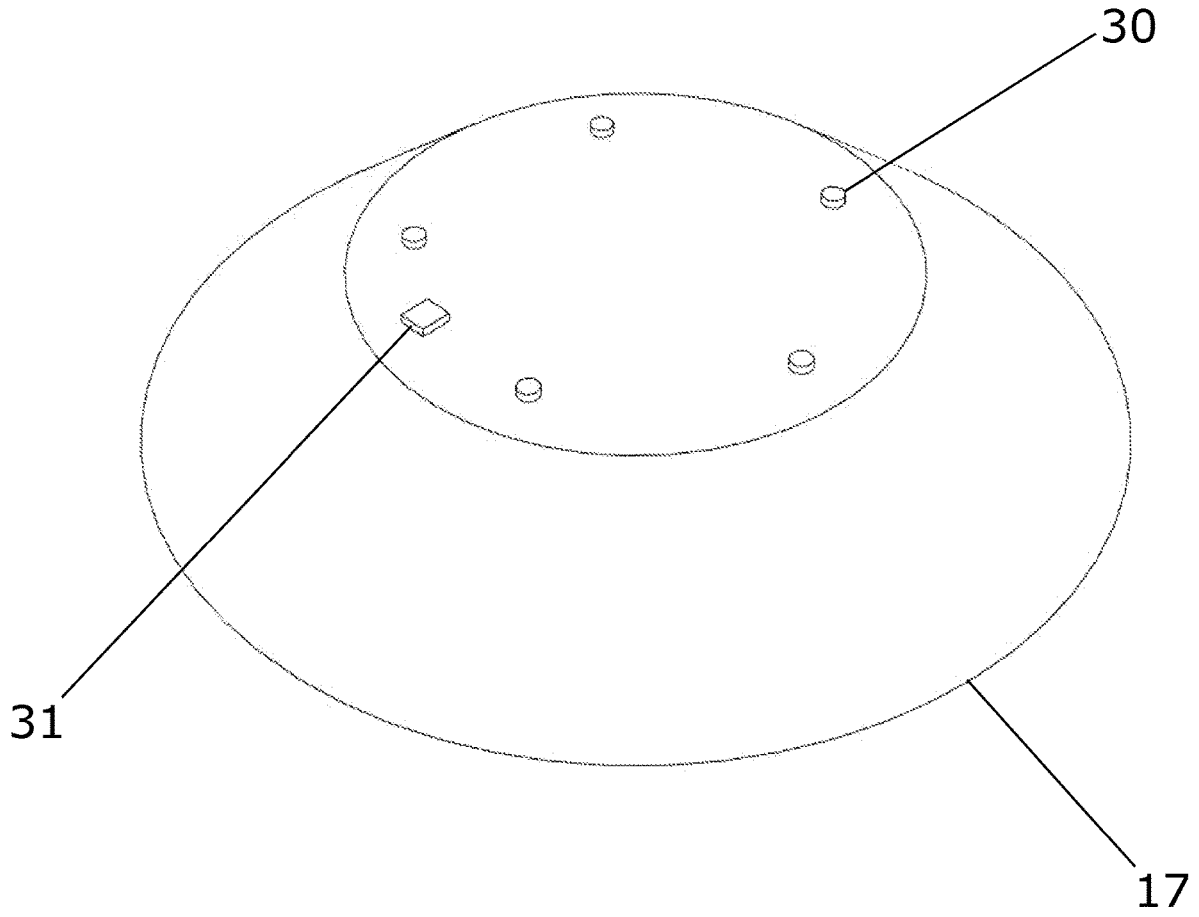
FIG. 18 shows another embodiment of an accessory mounting system that utilizes magnets for retention.
Figure 19:
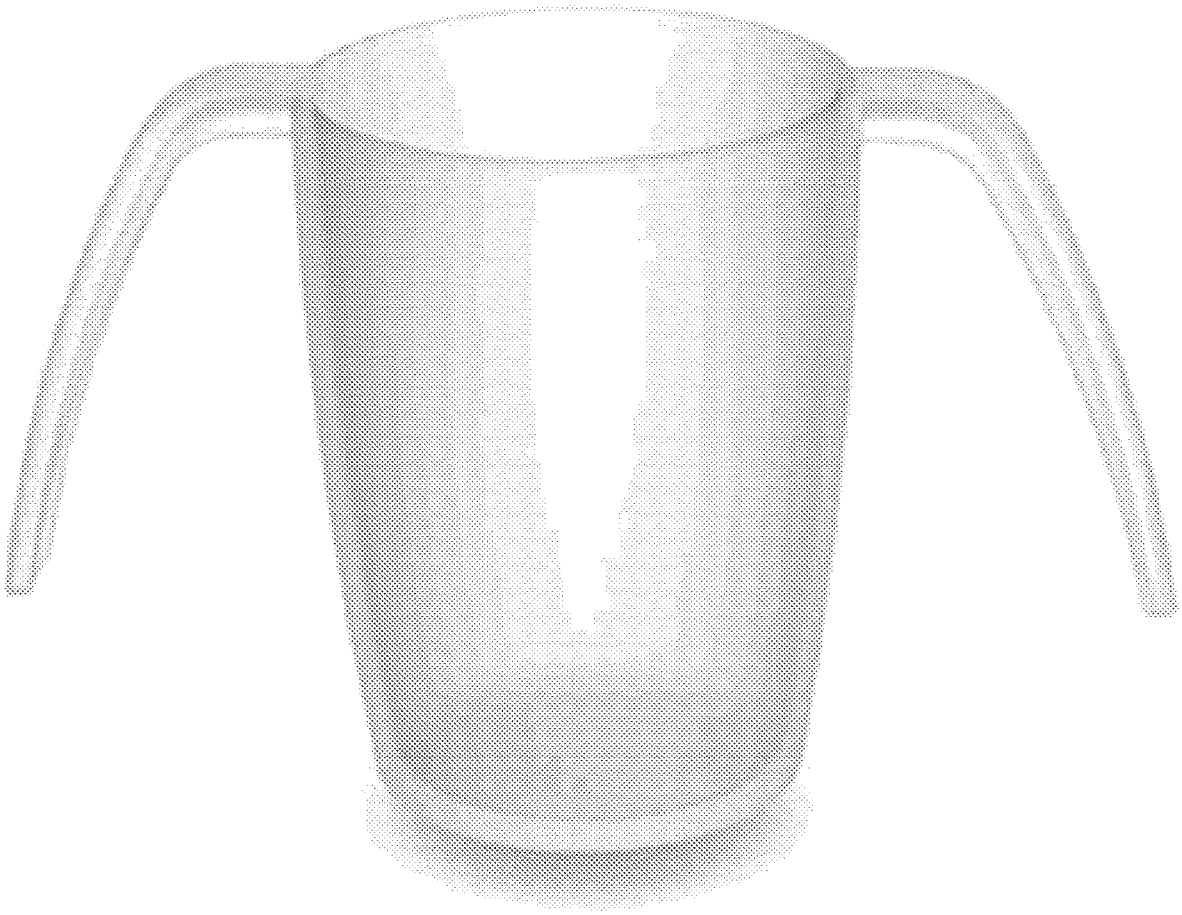
FIG. 19 illustrates a prior two handled cup holder.

An additional embodiment of the accessory mount assembly is shown in FIG. 18. In this embodiment any accessory base (17) in mated to the shell base (1) using a series of strong magnets (30) and aligned using one or more pin (31) and slot (not shown) pairs. This pin-slot pair will ensure an accessory base (17) may be positioned positively with respect to the handles (not shown), as in the preferred embodiment, and will ensure the magnets (30) align properly for maximum accessory retention. In lieu of a pin-slot pair, the alignment may also be accomplished by placing one magnet pair in an opposite polarity arrangement from all of the other pairs, such that an incorrectly aligned base will be repelled by two of the magnet pairs.

In general terms, receptacles as described herein may including one or more bands, and may include one or more slots through which a band may extend through an interior space of the receptacle to hold a container therein. When more than one band and slot is provided, a slot may be vertically spaced from another slot in the receptacle, may be circumferentially spaced from another slot in the receptacle, or both. Multiple slots may be formed at a single vertical level. Slots may be different circumferential lengths from other slots. Slots at a single vertical position in the receptacle may form sets of slots, which may be composed of the same or different circumferential length slots. A slot, or a set of slots, may be the same or different from other slots, or sets of slots, in the receptacle. Further, a band or bands which extend through a slot or slots may be any of the band or bands described herein, and may be used with any of the slot or slots described herein.

From the descriptions above, several advantages of the automatic self-adjusting beverage container receptacle in various embodiments become evident:

The receptacle is more stable than a native beverage container (cup, can, bottle) while in the resting position by virtue of the wider base;

The two handles in an embodiment enable the end-user to firmly grasp the receptacle, as opposed to a flimsy or easily crushed plastic bottle or aluminum can, without crushing the container and spraying the contents on the table, user, and others nearby;

The two handles also permit the end-user to use both hands to better stabilize the receptacle and enclosed container while drinking, allowing him or her to be more self-sufficient and freeing caregivers to do other tasks or assist other persons;

The two or more rings of flexible bands allow for easy insertion and removal of beverage containers by direct insertion or twisting the container into the receptacle;

The two or more rings of flexible bands also stabilize containers of many sizes and shapes, including cans, bottles, and cartons in round, rectangular, or other shapes;

The two or more rings of flexible bands grip the beverage container and prevent it from sliding out of the receptacle when the receptacle is tipped beyond horizontal;

The ability to accept many types of containers means that the contents need not be transferred to another vessel for consumption, and the container may be recycled or disposed of when empty, rather than needing to be washed;

The accessory mount assembly of the bottom of the receptacle allows a variety of accessories with various functions to be temporarily, semi-permanently, or permanently attached to the receptacle. Such accessories might include an extra wide base or an active anti-shake base;

With the extra-wide base accessory, the receptacle becomes extremely stable in the resting position; and The open bottom permits spilled beverages to drain and enables the washing and sterilizing of the receptacle in a normal or inverted orientation in automated dishwashers.

Accordingly, the reader will see that the various embodiments of the automatic self-adjusting beverage container receptacle will both enable persons with certain physical impairments to continue to drink unassisted, and reduce the time and effort required of caregivers in caring for said person. The beverage container can quickly and easily be inserted into the receptacle by a caregiver, and the end-user with limited motor skills can lift and stabilize the receptacle more easily than they could the original container. Additionally, the automatic self-adjusting receptacle has the advantages in that:

it is more stable at rest;

it is more easily stabilized by the end-user through the use of two handles when in use;

the beverage container itself is stabilized and retained by two or more rings of flexible bands, preventing the container from shifting, rotating, tilting, or sliding out when lifted and angled for drinking;

the use of a receptacle allows the original beverage container to be used by the end user and then disposed of or recycled, reducing the need to wash alternative vessels;

an unlimited variety of accessories may be attached to the bottom of the receptacle, enabling such accessories to be tailored to the individual needs of the end-user.

Although the description above contains many specifics, these should not be construed as limiting the scope of the embodiments but as merely providing illustrations of some of several embodiments. For example, the receptacle may be made of many materials such as injection molded plastic or a combination of plastic and metal. It may be any color and of a range of sizes to cover a range of beverage containers, from very small to very wide or extra short or overly tall.

Thus, the scope of the embodiments should be determined by the appended claims and their legal equivalents, rather than by the examples given.

I claim:

1. An automatic self-adjusting beverage container receptacle, the receptacle comprising:

a shell having an exterior surface, a centerline, posts, and an open end;

a plurality of flexible bands arranged on a plurality of parallel planes with said flexible bands passing over said posts in the outer shell and through the interior of said shell, wherein the plurality of flexible bands are positioned to press against and stabilize a beverage container when said beverage container is inserted into the center of said shell, whereby said beverage container is inhibited by said plurality of flexible bands from shifting, tilting, or falling out of said shell when a user angles the receptacle to consume contents of said beverage container; and a plurality of vertically oriented grips which are attached to and separated from the shell exterior surface, whereby a person who may have reduced motor skills may grasp said grips to stabilize the receptacle with both hands when consuming a beverage contained within said beverage container and without having to directly manipulate said beverage container, wherein one of the plurality of vertically oriented grips is less than one hundred and eighty degrees (180°) from another of the plurality of oriented grips.

2. The receptacle according to claim 1, wherein at least one of said vertically oriented grips comprises a thumb indentation.

3. The receptacle according to claim 1, wherein said shell includes a closed end opposite said open end, and further comprising:

an accessory mounting assembly at said shell closed end, said accessory mounting assembly comprising at least one slot though which a tab on an accessory can be inserted and rotated, whereby accessories may be temporarily, semi-permanently, or permanently attached to said shell such that said accessories may further assist the user in stabilizing the receptacle when in use or at rest, or may assist a caregiver in helping the receptacle user.

4. The receptacle according to claim 3, further comprising said accessory, the accessory comprising:

said at least one tab, sized and configured to fit within said at least one slot.

5. The receptacle according to claim 3, further comprising a drain hole through said closed end.

6. The receptacle according to claim 4, wherein said at least one tab and said at least one slot are mutually positioned and configured to form an accessory keying system that permits said accessories to be attached in a specific orientation with respect to shell, whereby the accessory orientation may be specifically defined with respect to the user when necessary.

7. The receptacle according to claim 1, wherein each of said plurality of flexible bands has a polygonal shape.

8. The receptacle according to claim 1, wherein said plurality of flexible bands are arranged on at least two vertically spaced planes on said shell, whereby each of said two vertically spaced bands stabilize different vertical portions of said beverage container when inserted into said shell.

9. The receptacle according to claim 1, wherein said plurality of flexible bands are formed of a material which is elastic and permits said plurality flexible bands to flex outwardly to receive a container when inserted into the receptacle, and to provide an inwardly directed force against the container, said inwardly directed force being at least partially radially directed.

10. The receptacle according to claim 1, wherein said plurality of flexible bands are formed of a material which can generate static and dynamic frictional forces between each of said plurality of the bands and an external surface of the container when inserted into said receptacle, wherein said frictional forces can assist in holding the container in the receptacle and inhibit or prevent motion of the container relative to the plurality of bands and/or said receptacle.

11. The receptacle of claim 1, wherein one of the plurality of vertically oriented grips is placed one hundred and twenty (120) degrees apart from another of the plurality of vertically oriented grips.

12. The receptacle of claim 1, wherein the shell is of a cylindrical shape.

13. The receptacle of claim 12, wherein a top of the shell is wider than a base of the shell and the receptacle narrows from the top to the base.

14. The receptacle of claim 1, wherein the number of posts is at least three.

15. The receptacle of claim 14, wherein the posts are spaced equally apart along a circumference of the top of the shell.

16. The receptacle of claim 14, wherein the posts are spaced one hundred and twenty (120) degrees apart from each other.

17. The receptacle of claim 1, wherein a number of the vertically oriented grips is at least two.

* * * * *